US007735283B2

(12) United States Patent
Stanchfield

(10) Patent No.: US 7,735,283 B2
(45) Date of Patent: Jun. 15, 2010

(54) TRANSITION MOLDING AND INSTALLATION METHODS THEREFOR

(75) Inventor: Oliver Stanchfield, Garner, NC (US)

(73) Assignee: Pergo AG, Baar (CH)

( * ) Notice: Subject to any disclaimer, the term of this patent is extended or adjusted under 35 U.S.C. 154(b) by 0 days.

(21) Appl. No.: 11/785,174

(22) Filed: Apr. 16, 2007

(65) Prior Publication Data

US 2007/0245662 A1 Oct. 25, 2007

Related U.S. Application Data

(63) Continuation of application No. 11/343,199, filed on Jan. 31, 2006, now Pat. No. 7,207,143, which is a continuation-in-part of application No. 11/066,099, filed on Feb. 28, 2005.

(51) Int. Cl.
*E04C 3/00* (2006.01)

(52) U.S. Cl. ..... 52/464; 52/466; 52/468; 52/592.1

(58) Field of Classification Search ..... 52/464, 52/466, 468, 592.1, 287.1, 467, 288.1
See application file for complete search history.

(56) References Cited

U.S. PATENT DOCUMENTS 1,357,713 A * 11/1920 Lane ..... 52/464
1,576,527 A 3/1926 McBride
1,736,539 A 11/1929 Lachman
1,966,020 A 7/1934 Rowley
2,100,238 A * 11/1937 Burgess ..... 52/393
2,194,086 A * 3/1940 Horn ..... 403/40
2,363,429 A * 11/1944 Lowry ..... 52/396.05
2,796,624 A 6/1957 Speer (Continued)

FOREIGN PATENT DOCUMENTS

DE 3640822 6/1988

(Continued)

OTHER PUBLICATIONS

U.S. Appl. No. 10/360,802, published Feb. 10, 2003.

(Continued)

*Primary Examiner*—Richard E Chilcot, Jr.
*Assistant Examiner*—Jessica Laux
(74) *Attorney, Agent, or Firm*—Novak Druce & Quigg LLP

(57) ABSTRACT

The invention is a joint cover assembly for covering a gap adjacent an edge of a panel that covers a sub-surface, and a method of covering such a gap. The assembly includes a molding having a foot, a first arm, and a second arm. The foot is positioned along a longitudinal axis of the molding, and the first arm extends generally perpendicularly to the foot. The second arm may also extend generally perpendicularly to the foot. A tab depends from at least one of the first and second arms. At least one of the tab and the foot engage a track in order to position the assembly over the gap. The method includes the steps of placing the foot in the gap, pressing the respective panel engaging surfaces into contact with respective panels, and configuring at least one of the tab and the foot to cooperate to retain the molding in the gap when the assembly is in an installed condition.

4 Claims, 17 Drawing Sheets

U.S. PATENT DOCUMENTS

| | | | | | |
|---|---|---|---|---|---|
| 2,926,401 | A | | 3/1960 | Place | |
| 3,028,938 | A | | 4/1962 | Schorr | |
| 3,162,906 | A | * | 12/1964 | Dudley | 52/97 |
| 3,199,258 | A | | 8/1965 | Jentoft | |
| 3,286,425 | A | | 11/1966 | Brown | |
| 3,296,056 | A | | 1/1967 | Bechtold | |
| 3,331,171 | A | * | 7/1967 | Hallock | 52/278 |
| 3,339,329 | A | | 9/1967 | Berg | |
| 3,363,381 | A | | 1/1968 | Forrest | |
| 3,411,977 | A | | 11/1968 | Slater, Jr. | |
| 3,435,574 | A | | 4/1969 | Hallock | |
| 3,488,828 | A | * | 1/1970 | Gallagher | 29/451 |
| 3,543,326 | A | | 12/1970 | Rohrberg | |
| 3,665,666 | A | | 5/1972 | Delcroix | |
| 3,670,470 | A | | 6/1972 | Thom | |
| 3,671,369 | A | * | 6/1972 | Kvalheim et al. | 428/105 |
| 3,696,461 | A | | 10/1972 | Kelly | |
| 3,696,575 | A | * | 10/1972 | Armstrong | 52/288.1 |
| 3,745,726 | A | | 7/1973 | Thom | |
| 3,758,650 | A | | 9/1973 | Hurst | |
| 3,760,544 | A | | 9/1973 | Hawes | |
| 3,810,707 | A | | 5/1974 | Tungseth | |
| 3,953,661 | A | | 4/1976 | Gulley | |
| 4,059,933 | A | | 11/1977 | Funk | |
| 4,067,155 | A | | 1/1978 | Ruff | |
| 4,198,455 | A | | 4/1980 | Spiro | |
| 4,292,774 | A | | 10/1981 | Mairle | |
| 4,445,306 | A | | 5/1984 | Schauffele | |
| 4,455,803 | A | | 6/1984 | Kornberger | |
| 4,461,131 | A | | 7/1984 | Pressell | |
| 4,504,347 | A | | 3/1985 | Munk | |
| 4,520,062 | A | | 5/1985 | Ungar | |
| 4,594,347 | A | | 6/1986 | Ishikawa | |
| 4,643,237 | A | | 2/1987 | Rosa | |
| 4,653,138 | A | | 3/1987 | Carder | |
| 4,747,197 | A | | 5/1988 | Charron | |
| 4,757,657 | A | | 7/1988 | Mitchell | |
| 4,806,435 | A | | 2/1989 | Athey | |
| 4,940,503 | A | | 7/1990 | Lindgren | |
| 5,034,272 | A | | 7/1991 | Lindgren | |
| 5,074,089 | A | | 12/1991 | Kemmer | |
| 5,155,952 | A | | 10/1992 | Herwegh | |
| 5,365,713 | A | | 11/1994 | Nicholas | |
| D373,203 | S | | 8/1996 | Kornfalt | |
| 5,581,967 | A | | 12/1996 | Glatz | |
| 5,657,598 | A | | 8/1997 | Wilbs | |
| 5,688,569 | A | | 11/1997 | Gilmore | |
| 5,695,875 | A | | 12/1997 | Larsson | |
| 5,706,623 | A | | 1/1998 | Brown | |
| 5,888,017 | A | | 3/1999 | Corrie | |
| 5,937,612 | A | | 8/1999 | Winer et al. | |
| 6,073,408 | A | | 6/2000 | Winer et al. | |
| 6,093,473 | A | | 7/2000 | Min | |
| 6,141,920 | A | | 11/2000 | Kemper | |
| 6,158,915 | A | | 12/2000 | Kise | |
| 6,219,982 | B1 | | 4/2001 | Eyring | |
| 6,230,385 | B1 | | 5/2001 | Nelson | |
| 6,253,514 | B1 | | 7/2001 | Jobe | |
| 6,345,480 | B1 | | 2/2002 | Kemper | |
| 6,421,970 | B1 | | 7/2002 | Martensson | |
| 6,517,935 | B1 | | 2/2003 | Kornfalt | |
| 6,588,165 | B1 | | 7/2003 | Wright | |
| 6,647,680 | B2 | | 11/2003 | Daly | |
| 6,745,534 | B2 | | 6/2004 | Kornfalt | |
| 6,805,951 | B2 | | 10/2004 | Kornfalt | |
| 6,860,074 | B2 | | 3/2005 | Stanchfield | |
| 2002/0127374 | A1 | | 9/2002 | Spratling | |
| 2002/0148551 | A1 | | 10/2002 | Knauseder | |
| 2002/0189747 | A1 | | 12/2002 | Steinwender | |
| 2003/0118812 | A1 | | 6/2003 | Kornfalt et al. | |
| 2003/0154678 | A1 | | 8/2003 | Stanchfield | |
| 2003/0159389 | A1 | | 8/2003 | Kornfalt et al. | |
| 2004/0031226 | A1 | | 2/2004 | Miller et al. | |
| 2004/0031227 | A1 | | 2/2004 | Knauseder | |
| 2004/0041225 | A1 | | 3/2004 | Nemoto | |
| 2005/0003149 | A1 | | 1/2005 | Kornfalt et al. | |
| 2005/0150182 | A1 | | 7/2005 | Stanchfield | |
| 2005/0166526 | A1 | | 8/2005 | Stanchfield | |
| 2008/0034696 | A1 | * | 2/2008 | Neuhofer | 52/466 |

FOREIGN PATENT DOCUMENTS

| | | | |
|---|---|---|---|
| DE | 29703962 | | 4/1997 |
| DE | 19821938 | | 11/1999 |
| DE | 517353 | | 5/2002 |
| DE | 10131248 | | 1/2003 |
| SE | 467150 | B | 6/1992 |
| SE | 9904533 | | 6/2001 |
| WO | 9612857 | | 5/1996 |
| WO | 9901628 | | 1/1999 |
| WO | 0120101 | | 3/2001 |
| WO | 0131141 | | 5/2001 |
| WO | 03093686 | | 11/2003 |

OTHER PUBLICATIONS

"Wood Flooring," Floors, Stairs & Carpets, Time Life Books, Inc., Jan. 1994, p. 14.
FN Neuhofer Holz, "Profiles in Various Kinds and Innovative Accessories," Certified according to DIN EN ISO 9002 (Neuhofer Holz Catalog).
Haro Wand and Decke (Haro Catalog).
Original Pergo the Free and Easy Floor (Pergo Catalog).
Reexamination U.S. Appl. No. 90/007,365.
Reexamination U.S. Appl. No. 90/007,526.
Faus Group Catalog.
Pergo Original Catalog, Jan. 1999.
Ceiling Program.
Meister Panels; Meister-Listen Schulte GmbH.
B.S. Bauprogram Handelsgesellschaft mbH Catalog.
Formica Flooring Catalog; Formica Corporation, 1999.
Decades Laminate Flooring.
Marcarena Flooring; Formica Corporation, 1998.
Magazin Parkett; Feb. 1995.
Bob Vila's Workshop—The Ultimate Illustrated Handbook for the Home Workshop, Bob Vila.
Time Life Catalog; pp. 1-35; 1994.
Sweets Catalog File, Products for General Building and Renovation; McGraw Hill Information Systems Co.; Feb. 1986.
Search Report dated Aug. 9, 2006.
Search Report dated Aug. 22, 2006.
"Wood Flooring," Floors, Stairs & Carpets, Time Life Books, Inc., Jan. 1994.

* cited by examiner

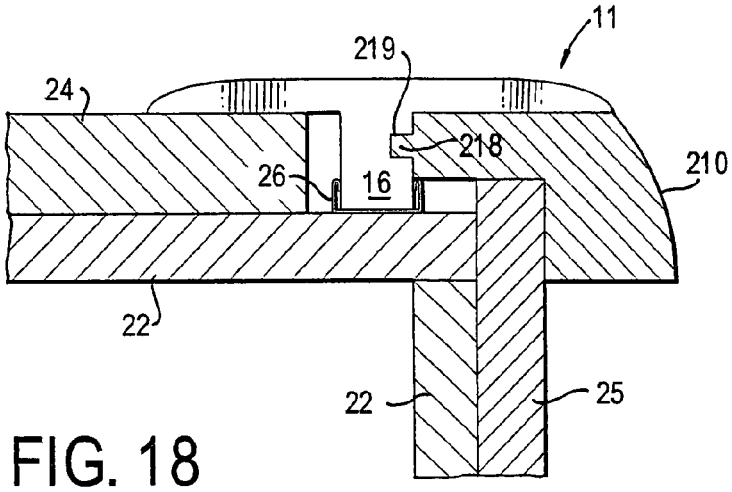
FIG. 18
FIG. 19
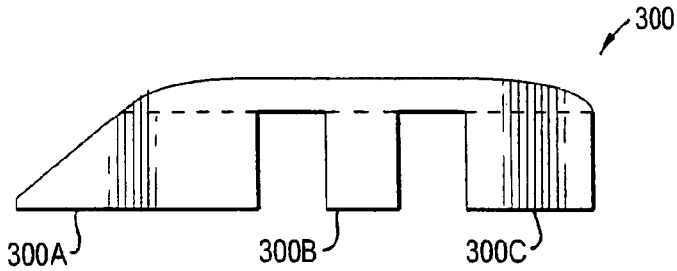
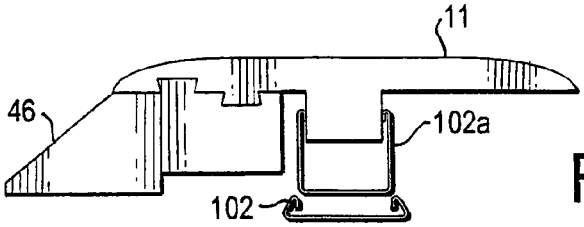
FIG. 20a
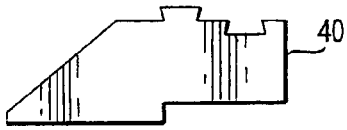
FIG. 20b
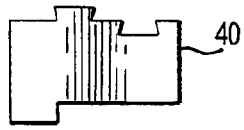
FIG. 20c

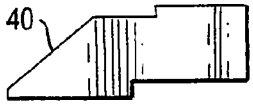
FIG. 26a
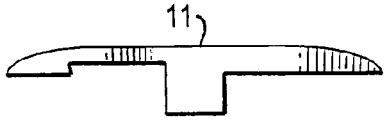
FIG. 26b
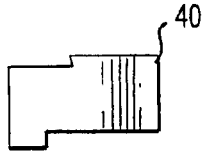
FIG. 26c
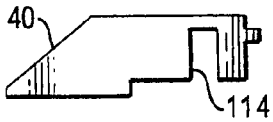
FIG. 27a
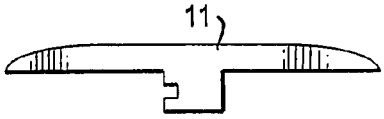
FIG. 27b
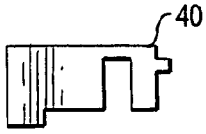
FIG. 27c
FIG. 28
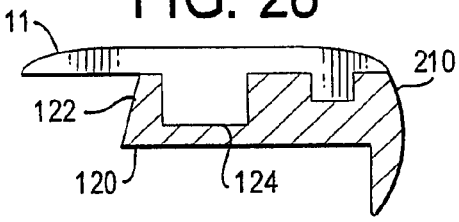
FIG. 29
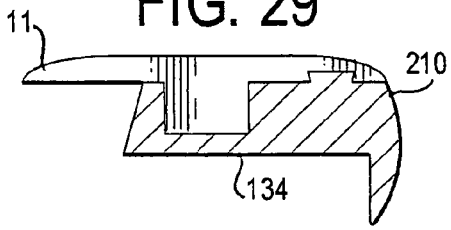
FIG. 30
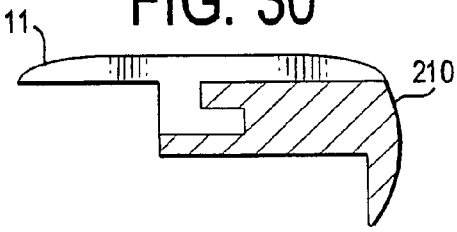
FIG. 31
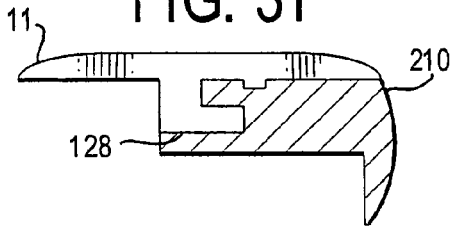
FIG. 32
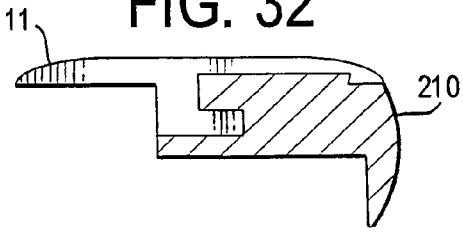
FIG. 33
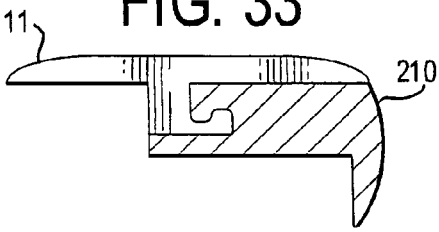

FIG. 44
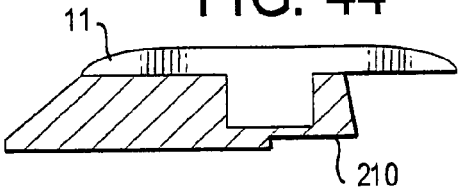
FIG. 45
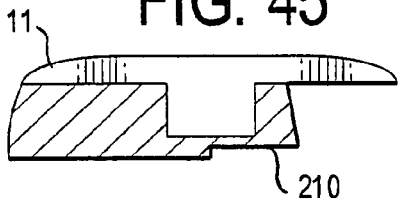
FIG. 46
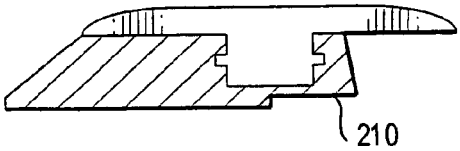
FIG. 47
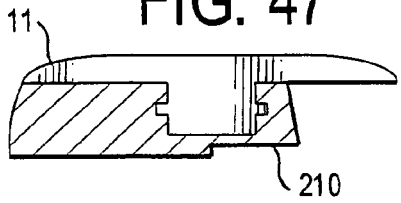
FIG. 48
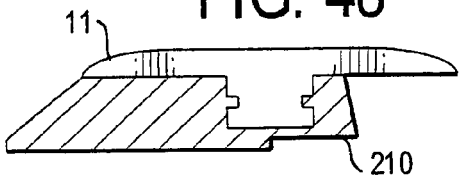
FIG. 49
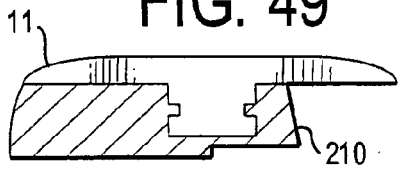
FIG. 50
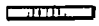
FIG. 51
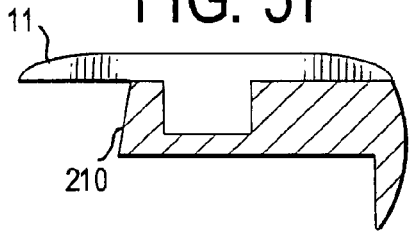
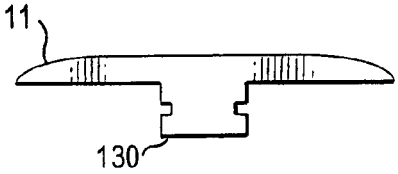
FIG. 52
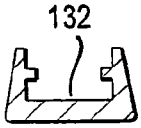
FIG. 53

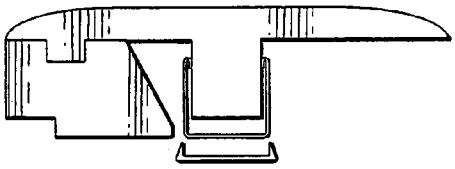
FIG. 54
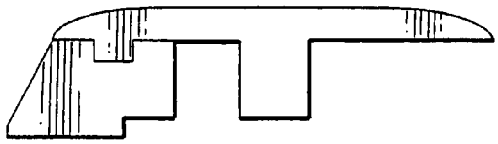
FIG. 55
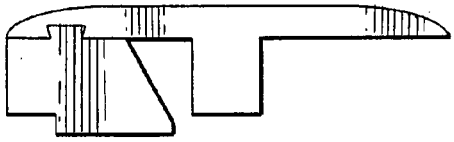
FIG. 56
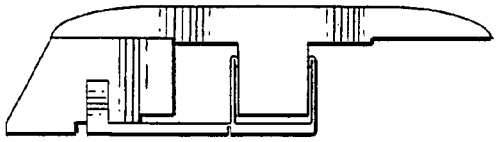
FIG. 57
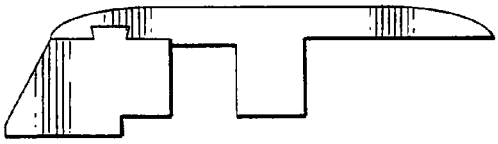
FIG. 58
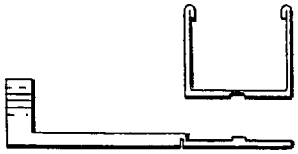
FIG. 59
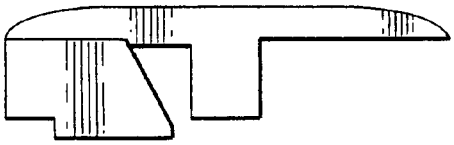
FIG. 61
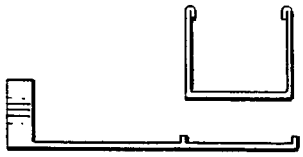
FIG. 60
FIG. 62
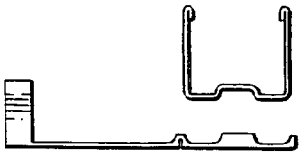

TRANSITION MOLDING AND INSTALLATION METHODS THEREFOR

This application is a continuation of U.S. application Ser. No. 11/343,199, having been filed Jan. 31, 2006, which is a Continuation-in-Part of U.S. application Ser. No. 11/066,099, having been filed Feb. 28, 2005, each of which are incorporated by reference in its entirety. U.S. application Ser. No. 10/347,489 (now U.S. Pat. No. 6,860,074), having been filed on Jan. 21, 2003, U.S. application Ser. No. 09/986,414, having been filed on Nov. 8, 2001, and U.S. application Ser. No. 10/748,852, having been filed on Dec. 31, 2003, are also each herein incorporated by reference in its entirety.

BACKGROUND

1. Field of the Invention

The invention is a joint cover assembly that includes a molding, similar to a transition molding between two separate parts, such as a T-Molding, for covering a gap that may be formed between adjacent panels in a generally planar surface, such as between two adjacent flooring or wall or ceiling materials; or between a floor and a hard surface or carpet, or even a riser and a runner in a step (or a series of steps).

2. Background of the Invention

Hard surface floors, such as wood or laminate flooring have become increasingly popular. As such, many different types of this flooring have been developed. Generally, this type of flooring is assembled by providing a plurality of similar panels. The differing types of panels that have developed, of course, may have differing depths and thicknesses. The same is true when a laminate floor (often referred to as a "floating floor") abuts another hard surface, such as a resilient surface (such as vinyl), tile or another laminate surface, a ceramic surface, or other surface, e.g., natural wood flooring. Thus, when laminate panels having different thicknesses or different floor covering materials are placed adjacent to a laminate floor, transition moldings are often used to create a transition between the same.

Additionally, one may desire to install floor panels adjacent to an area with different types of material. For example, one may desire to have one type of flooring in a kitchen (e.g., solid wood, resilient flooring, laminate flooring or ceramic tile), and a different appearance in an adjacent living room (e.g., linoleum or carpeting), and an entirely different look in an adjacent bath. Therefore, it has become necessary to develop a type of molding or floorstrip that could be used as a transition from one type of flooring to another.

A problem is encountered, however, when flooring materials that are dissimilar in shape or texture are used. For example, when a hard floor is placed adjacent a carpet, problems are encountered with conventional edge moldings placed therebetween. Such problems include difficulty in covering the gap that may be formed between the floorings having different height, thickness or texture.

Moreover, for purposes of reducing cost, it is important to be able to have a molding that is versatile, having the ability to cover gaps between relatively coplanar surfaces, as well as surfaces of differing thicknesses.

It would also be of benefit to reduce the number of molding profiles that need to be kept in inventory by a seller or installer of laminate flooring. Thus, the invention also provides a method by which the number of moldings can be reduced while still providing all the functions necessary of different styles transition moldings.

SUMMARY OF THE INVENTION

The invention is a joint cover assembly for covering a gap between edges of adjacent floor elements, such as floor panels of laminate or wood, although it may also be used as a transition between a laminate panel and another type of flooring, e.g., carpet, linoleum, ceramic, wood, etc. The assembly typically includes a body having a foot positioned along a longitudinal axis, and a first arm extending generally perpendicularly from the foot. The assembly may include a second arm also extending generally perpendicular from the foot. Securing elements are provided to secure attachments to the at least one of the first and second arms. These securing elements may take the form of adhesive. The securing elements may also be in the form of a tab, which may be provided on at least one of the first or second arms, displaced from, or adjacent, the foot, extending generally perpendicularly from the arm.

The outward-facing surface of the assembly may be formed as a single, unitary, monolithic surface that covers both the first and second arms. This outward-facing surface may be treated, for example, with a laminate or a paper, such as a decor, impregnated with a resin, in order to increase its aesthetic value, or blend, to match or contrast with the panels. Preferably, the outward facing surface has incorporated therein a material to increase its abrasion resistance, such as hard particles of silica, alumina, diamond, silicon nitride, aluminum oxide, silicon carbide and similar hard particles, preferably having a Moh's hardness of at least approximately 6. This outward-facing surface may also be covered with other types of coverings, such as foils (such as paper or thermoplastic foils), paints or a variety of other decorative elements.

The assembly is preferably provided with a securing means to prevent the assembly from moving once assembled. In one embodiment, the securing means is a clamp, designed to grab the foot. Preferably, the clamp includes a groove into which the foot is inserted. In a preferred embodiment, the clamp or rail may joined directly to a subsurface below the floor element, such as a subfloor, by any conventional means, such as a nail, screw or adhesive.

A shim may also be placed between the foot and the subfloor. In one embodiment, the shim may be positioned on the underside of the clamp; however, if a clamp is not used, the shim may be positioned between the foot and the subfloor. The shim may be adhered to either the foot or subfloor using an adhesive or a conventional fastener, e.g., nail or screw.

The assembly may also include a leveling block or reducer positioned between at least one of the first and second arms and the adjacent floor. The leveling block generally has an upper surface that engages the arm, and a bottom surface that abuts against the adjacent floor. In a preferred embodiment, the leveling block has a channel or groove formed in an upper surface, configured to receive the tab on the arm. The particular size of leveling block is often chosen to conform essentially to the difference in thicknesses between the first and second panels. The exposed surfaces of the leveling block are typically formed from a variety of materials, such as a carpet, laminate flooring, ceramic or wood tile, linoleum, turf, paper, natural wood or veneer, vinyl, wood, ceramic or composite finish, or any type of covering, while the interior of the leveling block is generally formed from wood, fiberboard, such as high density fiberboard (HDF) or medium density fiberboard (MDF), plastics, or other structural material, such as metals or composites, at least over a portion of the surface thereof may be covered with a foil, a plastic, a paper, a décor or a laminate to match or contrast with the first and second arms. The leveling block additionally facilitates the use of floor coverings having varying thicknesses when covering a subfloor. The leveling block helps the molding not only cover the gap, but provide a smoother transition from one surface to another.

Alternatively, the tab may be positioned to slidingly engage the edge of a panel when no leveling block is used. A lip may additionally be provided and positioned on the tab in order to slidingly engage a protuberance, adjacent an upper edge of the clamp, in order to retain the assembly in its installed position.

The tab is preferably shaped as to provide forces to maintain the assembly in the installed position. Thus, typically the tab may be frustum-shaped, (e.g., dove-tailed) with its narrow edge proximate the arm and the wider edge furthest from the arm. Additionally, the tab may be lobe shaped, having a bulbous end distal from the arm. In another embodiment, only one side of the tab need be tapered (e.g., half dove-tailed). Of course, any suitable shape is sufficient, as long as the engagement of the tab and groove can provide enough resistive forces to hinder removal of the installed assembly. By forming a suitable groove in the leveling block, the tab can help to secure the assembly in place. Typically, a corresponding groove, having a similar shape as the tab is included in the leveling block or reducer, e.g., having its wider base distal the arm and its narrower opening proximate the arm. It is to be understood by those skilled in the art that although the description throughout this specification is that the position of the tab is on the at least one of the first and second arms, and the groove is on the attachment, e.g., leveling block, the relative position of the tab and groove can be reversed.

The assembly may additionally be used to cover gaps between tongue-and-groove type panels, such as glueless laminate floor panels. In addition to the uses mentioned above, the tab may also be designed to mate with a corresponding channel in the panel, the edge of one of the flooring elements, or may actually fit within a grooved edge. In order to better accommodate this type of gap, a second tab may be positioned to depend from the second panel engaging surface.

An adhesive, such as a glue, a microballoon adhesive, contact adhesive, or chemically activated adhesive including a water-activated adhesive, may be also positioned on the tab, in the groove, on the foot, and on at least one of the arms. Of course, such an adhesive is not necessary, but may enhance or supplement the fit of the assembly over the gap between the floor elements. Additionally, the adhesive may assist in creating a more air-tight or moisture-tight joint.

The assembly may be used in other non-coplanar areas, such as the edge between a wall and a floor, or even on stairs. For example, the assembly may include the first and second arms, and foot as described above, but instead of transitioning between two floor elements placed in the same plane, may form the joint between the horizontal and vertical surfaces of a single stair element.

The inventive assembly may be used for positioning between adjacent tongue-and-groove panels; in this regard, the assembly functions as a transition molding, which provides a cover for edges of dissimilar surfaces. For example, when installing floors in a home, the assembly could be used to provide an edge between a hallway and a bedroom, between a kitchen and living or bathroom, or any areas where distinct flooring is desired. Additionally, the assembly may be incorporated into differing types of flooring, such as wood, tile, linoleum, carpet, or turf.

The invention also is drawn to an inventive method for covering a gap between adjacent panels of a generally planar surface. The method includes multiple steps, including, inter alia, placing the foot in the gap, pressing the respective arms in contact with the respective floor elements, and configuring at least one of the tab and the foot to cooperate to retain the assembly in the gap after the assembly has been installed.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 18 shows a second embodiment of the assembly for use with stairs;

FIG. 19 is a side view of a generic element, which may be broken into the components of the invention; and FIGS. 20-81 are various modifications of molding of the invention.

DETAILED DESCRIPTION OF THE PREFERRED EMBODIMENTS

Figure 1:
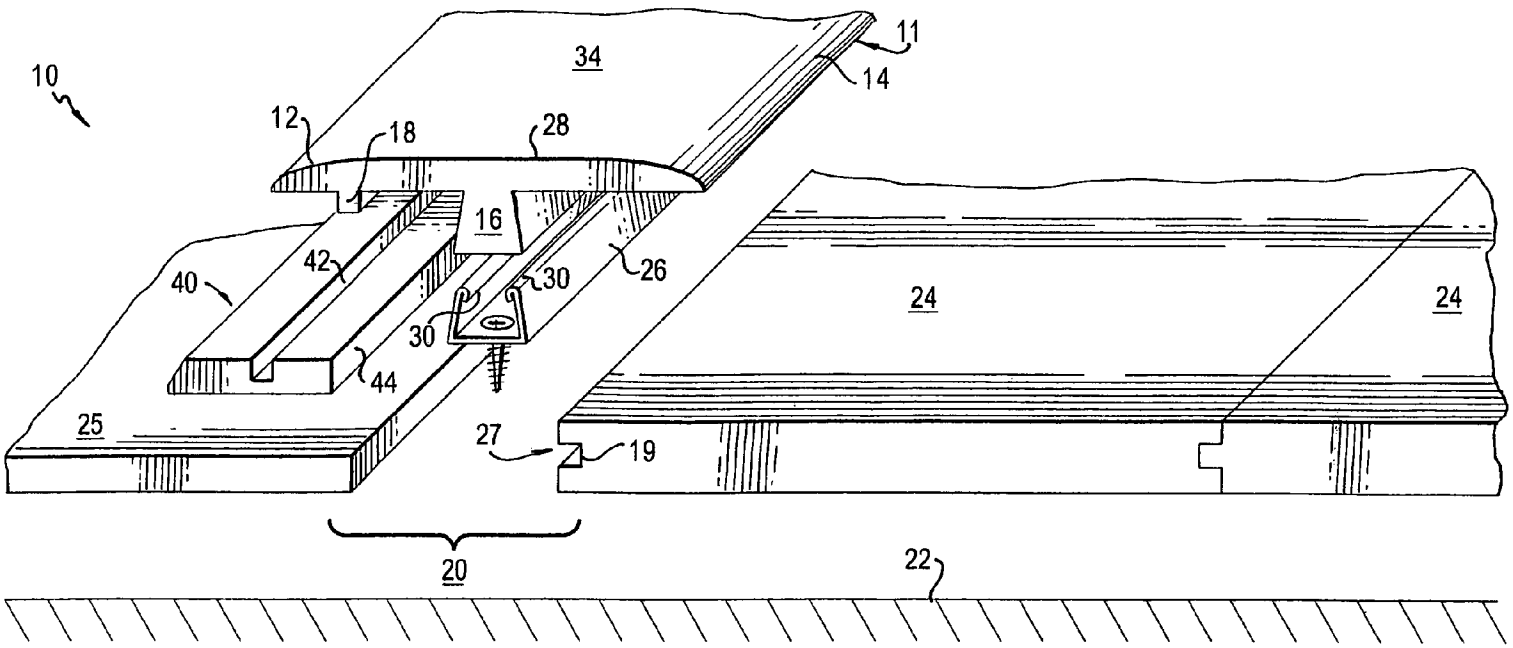
FIG. 1 is an exploded view of an embodiment of the joint cover assembly in accordance with the invention.

FIG. 1 shows an exploded view of the various parts of the inventive joint cover assembly 10. The assembly 10 includes a T-shaped molding 11, having a foot 16 formed so that it can fit in a gap 20 between adjacent floor elements 24, 25. FIG. 1 demonstrates a typical use, in which the gap 20 is formed adjacent an edge 27 of a floor element 24. Although FIG. 1 depicts all of the floor elements 24 to be conventional tongue-and-groove type floor panels (having a groove 27 positioned adjacent to the gap 20), this is merely one of any number of embodiments. For example, floor elements 24, 25 need not be the same type of floor element. Specifically, the floor elements 24 can be any type of flooring designed to be used as a floor or placed over a subfloor 22, e.g., tile, linoleum, laminate flooring, concrete slab, parquet, vinyl, turf, composite or hardwood. As is known, laminate floors are not attached to the subfloor 22, but are considered "floating floors." Although the figures illustrate particular locations for features such as the tab 18 and channel. 42, it is within the scope of the invention to reverse the relative locations of such features.

The molding 11 is provided with a first arm 12 and a second arm 14 extending in a single plane generally perpendicular to the foot 16. Preferably, the foot 16, first arm 12, and the second arm 14 form a general T-shape, with the arms 12 and 14 forming the upper structure and the foot 16 forming the lower structure. Although the foot 16 is shown as being positioned at a central axis of the molding 11, such is only a preferred embodiment. In other words, it is within the scope of the invention to vary the position of the foot 16 "off center" with respect to the first and second arms 12, 14. For example, the foot 16 may be placed at the midpoint, or anywhere in between, as is depicted, for example, in FIGS. 82-99.

As shown in FIGS. 82-111, a molding 1110 need not form a true right angle with its foot 1116. For example, the transition from a respective outstretched arm 1112 or 1114 to a foot 1116 may be achieved by one or more rounded sections, or a plurality of straight sections. While the figures only illustrate an angle of other than 90° between arm 1114 and foot 1116, it is within the scope of this invention to provide the transition between arm 1112 and foot 1116, or both transitions with such an angle. Typically, these transitions are formed by undercutting the desired angle, as will be described in greater detail below.

The molding 11, as well as any of the other components used in the invention, may be formed of any suitable, sturdy material, such as wood, polymer, fiberboard, plywood, or even a wood/polymer composite, such as stranboard. Due to the growing popularity of wood and laminate flooring and wood wall paneling, however, a natural or simulated woodgrain appearance may be provided as the outward facing surface 34 of the molding 11. The outward facing surface 34 may be a conventional laminate, such as a high pressure laminate (HPL), direct laminate (DL) or a post-formed laminate (as described in U.S. application Ser. No. 08/817,391, herein incorporated by reference in its entirety); a foil; a print, such as a photograph or a digitally generated image; or a liquid coating including, for example, aluminum oxide. Thus, in the event natural wood or wood veneer is not selected as the material, the appearance of wood may be simulated by coating the outer surface 34 with a laminate having a decor sheet that simulates wood. Alternatively, the decor can simulate marble, ceramic, terrazzo, stone, brick, inlays, or even fantasy patterns. Preferably, the outward facing surface 34 extends completely across the upper face of the molding, and optionally under surface 36 and 38 of arms 12 and 14, respectively.

The core structure of components of the invention, including the center of the molding 11, that is in contact with the outward facing surface 34 is formed from a core material. Typical core materials include wood based products, such as high density fiberboard (HDF), medium density fiberboard (MDF), particleboard, strandboard, plywood, and solid wood; polymer-based products, such as polyvinyl chloride (PVC), thermoplastics or thermosetting plastics or mixtures of plastic and other products, including reinforcements; and metals, such as aluminum, stainless steel, brass, aluminum or copper. The various components of the invention are preferably constructed in accordance with the methods disclosed by U.S. application Ser. No. 08/817,391, as well as U.S. application Ser. No. 10/319,820, filed Dec. 16, 2002, each of which is herein incorporated by reference in its entirety.

The resulting products typically have durability rating. As defined by the European Producers of Laminate Flooring, such products can have a durability rating of anywhere from AC1 to AC5. Preferably, the products of this invention have a rating of either AC3 or AC5.

Figure 1B:
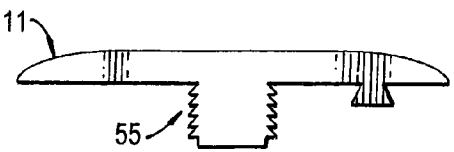
FIGS. 1A and 1B are alternate embodiments for the molding of the invention.

A securing element, such as a metal clamp, track or rail 26, may be coupled to the subfloor 22 within the gap 20 formed between the two floor elements 24. The clamp may be coupled to the subfloor 22 by fasteners, such as screws or any conventional coupling method, such as nails or glue. The clamp 26 and the foot 16 are preferably cooperatively formed so that the foot 16 can slide within the clamp 26 without being removed. For example, the clamp 26 may be provided with in-turned ends 30 designed to grab the outer surface of the foot 16 to resist separation in a vertical direction. Typically, the foot 16 has a dove-tail shape, having the shorter parallel edge joined to the arms 12 and 14; and the clamp 26 is a channeled element having a corresponding shape as to mate with the foot 16 and hold it in place. Additionally, the securing element may take the form of an inverted T-element 50 (FIG. 1A), configured to mate with a corresponding groove 52 in an end of foot 16, such that friction between the T-element 50 and the groove 52 secures the molding 11 in place, or, in the alternative, the end of the foot 16 may be provided with a narrowed section, designed to mate with a groove in the securing element. Finally, each of the T-element 50, mating section of the foot 16 and/or various grooves, may be provided with notched or barbed edges 55 to simultaneously assist in mating and resist disassembly (FIG. 1B). However, in an alternative embodiment, the securing element can be eliminated because the molding 11 can be affixed to one of the floor elements 24, 25, by, for example, an adhesive. Preferably, however, the molding 11 is not secured to both floor elements 24, 25, as to permit a degree of relative movement, or floating, between the floor elements 24, 25.

The clamp 26 may additionally be formed of a sturdy, yet pliable material that will outwardly deform as the foot 16 is inserted, but will retain the foot 16 therein. Such materials include, but are not limited to, plastic, wood/polymer composites, wood, and polymers. The clamp 26 may additionally engage recesses in, for example, sides of the foot 16.

A tab 18 is shown as extending downwardly from the first arm 12. As shown in FIG. 1, the tab 18 extends downward, or away from an outward facing surface 34 of the molding, and runs generally parallel to the foot 16. As shown in FIG. 1, the tab 18 may also be in the shape of a dove-tail with a shorter edge adjacent to the first arm 12; however, other suitable shapes are possible. The shape of the outwardly facing surface 34 of the molding 11 is shown as being convex in some of the Figures (e.g., FIGS. 1A, 1B and 7), and substantially planar in others (e.g., FIGS. 1, 2, 4, and 6). When the outwardly facing surface 34 is substantially planar, the edges of the molding 11 may either be upright or at an angle, typically angling away from the foot 16. However, the relative positions of the tongue/groove may also be reversed.

The assembly may further include a leveling block 40 otherwise known in the art as reducers. When flooring elements 24 and 25 are of differing heights, the leveling block 40 is positioned between either the first arm 12 or the second arm 14 and the subfloor 22. Preferably, the size of the leveling block 40 is selected to correspond essentially to the difference in heights of the two flooring elements 24 and 25. However, if an adjustable pad 1120 (as described below) is used, the particular height of the reducer is not particularly important. For example, if one flooring element 24 is a ceramic tile, having a thickness of 2" and the second flooring element 25 is vinyl, having a thickness of ¼", the leveling block 40 would typically have a thickness of 1¾" to bridge the difference and be placed between arm 12 and the other flooring element 25. Without the leveling block 40, a significant space would exist between the second flooring element 25 and the molding 11, allowing for moisture and dirt to accumulate. While the difference in heights of the flooring elements 24, 25 is generally caused by a difference in thickness between the two flooring elements 24, 25, the present invention may also be used to "flatten out" an uneven subfloor 22. In addition, a shim may be placed under the track to adjust for differences in floor thickness. In a preferred embodiment, the leveling block is provided with a channel 42 designed to receive the tab 18.

The width of the foot 16, 1116 may be different, depending upon the particular application. For example, when a reversible molding element 1250 is used, it is preferred that the width of the foot 16, 1116 be narrower to accommodate the proximal portions of the molding element. Typically, the clamp 26, 1126 is also adjusted to accommodate the appropriate foot 16, 1116.

Figure 6:
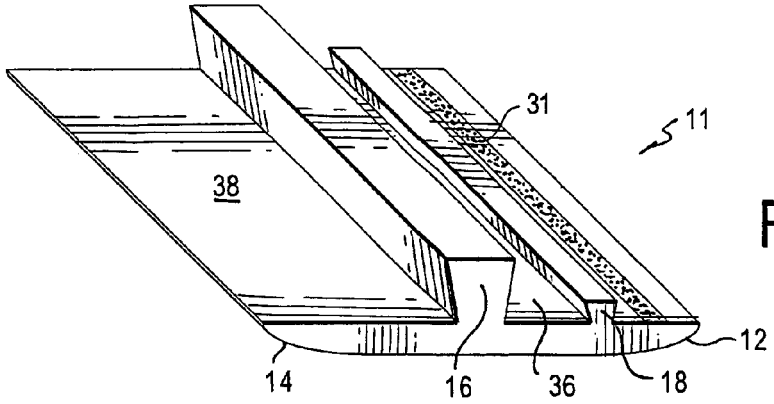
FIGS. 6-16 show comparative cross-sectional views of various embodiments of the molding portion of the joint cover assembly.

Even though the assembly 10 may function without any type of glue or adhesive, an alternate embodiment includes the placement of adhesive 31 on the molding 11. The adhesive may be placed on molding 11 at the factory (for example, pre-glued). Alternatively, the glue may be applied while the floor elements 24, 25 are being assembled. As shown in FIG. 6, the adhesive 31 may be provided as a strip-type adhesive, but any type of adhesive, such as glue, chemical or chemically-activated adhesive, water-activated adhesive, contact cements, microballoon or macroballoon encapsulated adhesive may be used. Additionally, while the embodiment in FIG. 6 shows a single adhesive strip 31 attached to the arm 12, the adhesive 31 may be attached to the tab 18, foot 16, and/or any location where two pieces of the assembly are joined. In some embodiments, the adhesive may be used as an alternative to tab 18 and groove 42. Preferably, adhesive 31 is only applied to one of the arms 12, 14 in order to allow or accommodate some slight relative movement that may occur during changes of temperature, for example. This relative movement is known in the flooring art as "float". Allowing float may also eliminate unneeded material stresses as well, thereby reducing warping or deterioration of the material surface. Typical adhesives used in the invention include a fresh adhesive, such as PERGO GLUE (available from Perstorp AB of Perstorp, Sweden), water activated dry glue, dry glue (needing no activation) or an adhesive strip with a peel off protector of paper.

Figure 2:
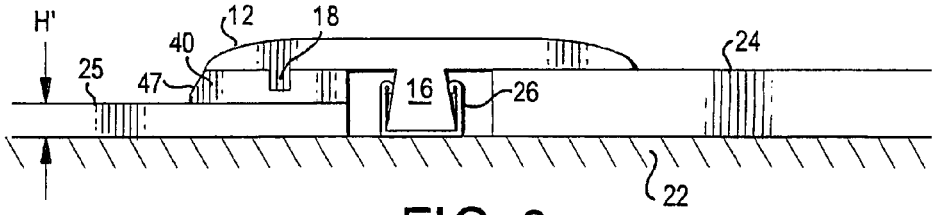
FIG. 2 is a perspective view of a second embodiment of the joint cover assembly in accordance with the invention.
Figure 3:
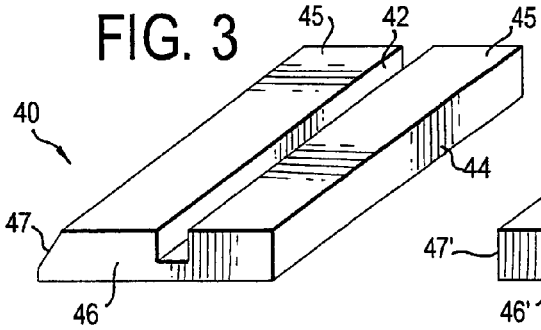
FIGS. 3 and 3A are comparative perspective views of embodiments of the leveling block.

FIG. 2 shows a typical embodiment of the assembly 10 in an installed condition, wherein the floor elements 24 and 25 are of differing thicknesses (H and H' respectively). Of course, the element 24 may be of any type of covering, such as carpet, turf, tile, linoleum or the like. As shown in FIG. 3, the leveling block 40 typically includes a substantially flat bottom 46, and a top 45 having a groove 42, and an inner surface 44. The top 45 of the leveling block 40 is designed to firmly abut the under surface 36 of the first arm 12, while the bottom 46 abuts floor element 25. Typically, the groove 42 is shaped as to firmly hold the tab 18. By having a corresponding shape, for example, the groove 42 can have a dove-tail shape, where both lateral sides diverge from the upper surfaces or a "half-dove tail," where only one of the two sides is so configured. The inner surface 44 of the leveling block 40 need not abut the foot, as generally, a small amount of clearance is provided between the clamp 26 or foot 16 and the inner surface 44 of the leveling block. However, the inner surface 44 may be configured to contact either of the clamp 26 or foot 16. The tab 18 may also be of a shape different than groove 42, e.g., a wedged-shaped tab fitting within a straight-walled groove. In other embodiments, friction will be sufficient to maintain the position of the tab and groove elements.

The leveling block 40 may be made of a composite, pliable material that is also resilient. For example, the tab 18 may be formed to be slightly larger than the opening of the channel 42, thereby forcing the channel 42 to outwardly deform in order to accommodate the tab 18, and therefore snap-fit together.

As shown in FIG. 3, the outer surface 47 of the leveling block 40 is generally treated to match or blend with the outer surface 34 of the molding or the floor element 24, 25 in order to improve aesthetics.

Figure 3A:
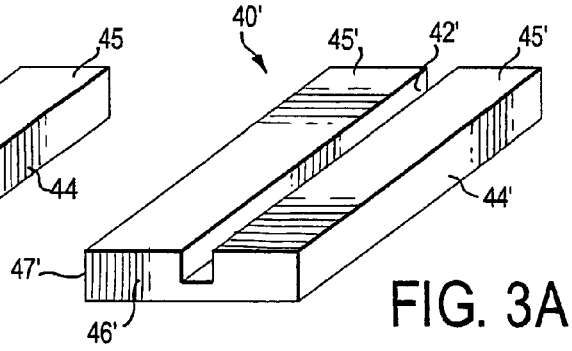

FIG. 3A shows an alternate embodiment of a leveling block 40'. An outer surface 47' of this embodiment is configured generally perpendicular to an upper surface 44' and a lower surface 46' of the leveling block 40'. This alternate configuration of the outer surface 47' not only provides a different appearance, it also has been shown to be preferred when softer surfaces, such as carpet or turf, are positioned beneath the lower surface 46' of the leveling block 40'.

Figure 4:
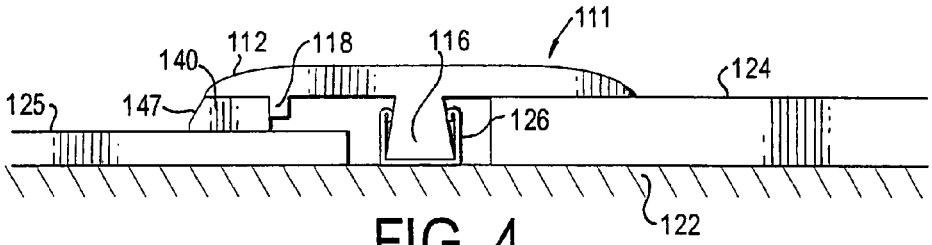
FIG. 4 is perspective view of an additional embodiment of the joint cover assembly in accordance with the invention.

FIG. 4 shows yet another alternate embodiment of the leveling block 140. The leveling block 140 includes a bottom 146, and a top 145 and an inner surface 144. The top 145 of the leveling block 140 is designed to firmly abut the under surface 36 of the first arm 12, while the bottom 146 abuts floor element 25. This leveling block 140 is positioned between a first arm 112 of the molding 111 and the flooring element 125. In this embodiment of the assembly 110, the tab 118 engages the inner surface 144 of the leveling block 140.

Figure 5:
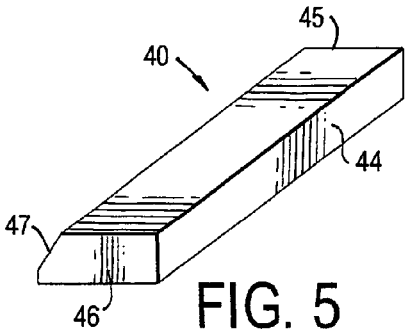
FIGS. 5 and 5A are comparative perspective views of embodiments of the leveling block.

FIG. 5 shows an embodiment of a leveling block 140 that may be used in the assembly shown in FIG. 4. Specifically, the leveling block 140 in FIG. 5 has a solid, uninterrupted upper surface 145, without the need for a channel because the tab (118, as in FIG. 4) will engage the inner surface 144 of the leveling block instead of the top surface 145. In such an embodiment, the tab 118 may also be adjacent the foot. In some embodiments, the use of adhesive will reinforce the positioning of the leveling block 140 relative to tab 118.

Figure 5A:
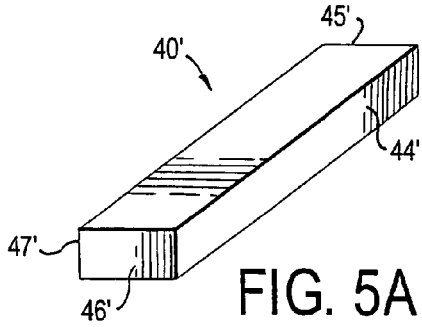

FIG. 5A shows an additional shape of a leveling block 140' that can be incorporated into the assembly shown in FIG. 4. Leveling block 140' has a front surface 146' that will be generally perpendicular to a floor 122 (as shown in FIG. 4) when the leveling block 140' is installed. This perpendicular configuration of the front surface 147' not only provides a different appearance, it has also been found to be preferred with softer surfaces, such as carpet or turf. FIG. 6 shows an underside view of the molding 11. In particular, the first under surface 36 of the first arm 12, and the second under surface 38 of the second arm 14 are shown. In one embodiment, under surface 36 is provided with the adhesive 31 positioned to adhere to a surface of a floor element 24, 25 or leveling block 40, 40', 140, 140'.

FIGS. 7-15 show various cross-sectional views of the molding 11. These figures show comparative configurations for the arms 12, 14, the tab 18, and the shape of molding 11.

Figure 7:
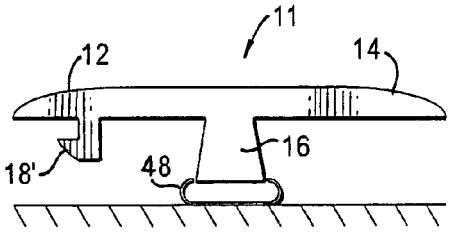
Figure 8:
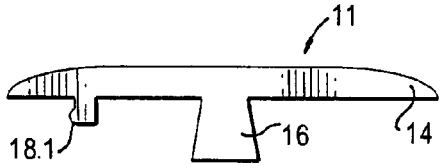
Figure 9:
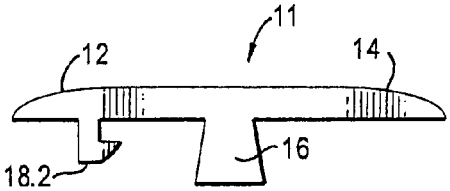
Figure 10:
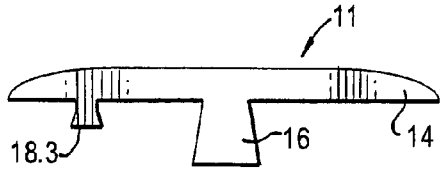
Figure 11:
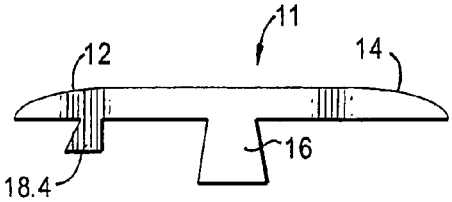
Figure 12:
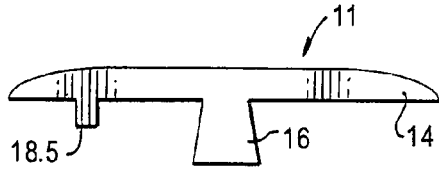
Figure 13:
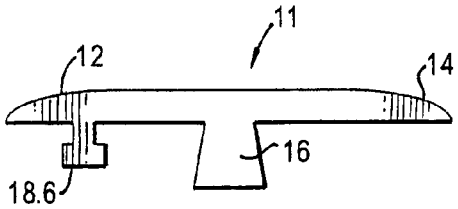
Figure 14:
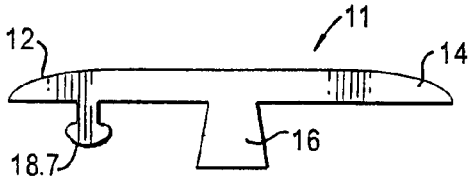
Figure 15:
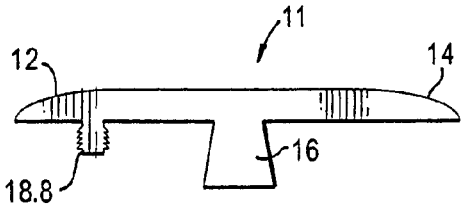

In FIG. 7, the tab 18 is selected to be an outward-facing hook having a barb facing away from the foot 16, while the upper surface of the molding has a convex curvature. This particular selection for the tab 18 may be used to engage an edge or groove of an adjacent floor element 24, 25, or, in the alternative, an adjacent leveling block 40. Additionally, a shim 48 may be positioned between the foot 16 and the subfloor 22. The shim 48 is generally formed of a pliable and flexible, yet durable, material, such as a polymer, preferably a polymer exhibiting electrometric properties. The shim 48 may be used in place of, or in combination with, clamp 26. Preferably, the shim 48 is sized in accordance with the size of the clamp 26, 1126.

FIGS. 8-15 show cross-sections of other shapes for the molding 11. The configurations of the moldings are very similar, except for the shape of the tab 18. The differing tabs have been assigned decimal numbers beginning with 18, for clarity purposes. A tab 18.1 (FIG. 8) is a bulbous shape, having its rounded end furthest from the arm 12 tab 18.2 (FIG. 9) is provided with a hook-shape with a point facing the foot 16. In the embodiment shown in FIG. 10, a tab 18.3 is in the shape of a dove-tail, similar to the shape of the tab 18 shown in FIG. 2. The tab 18 may additionally be configured to have a substantially rectangular cross section with two opposite rounded off corners, as shown in FIGS. 82-111, or any of the other shapes described herein, with one or more of the corners/ends being rounded.

The purpose of the various-shaped tabs (18-18.8) is multifold. Primarily, the tab 18 serves to engage the channel 42 of the leveling block 40, which is used when covering of differing thickness is used. Alternatively, the respective tab (18-18.8) may engage an edge of a panel, carpet, turf, or other type of floor covering. As shown herein, the respective tab (18-18.8) may even be configured to engage a leveling block.

It is additionally considered within the scope of the invention to eliminate the tab. In such an embodiment, preferably, the molding 11 includes an adhesive on the under surface 36, 38 of one of the arms 12, 14.

Figure 16:
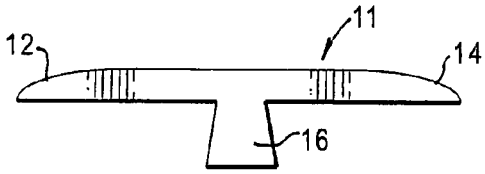

With respect to FIG. 16, the invention may also be used when the floor elements are not co-planar. For example, one embodiment includes a stair nose attachment 210 that can be attached to the same molding 11, as described above. As used herein, a stair nose attachment is a component capable of mating with the molding 11 so as to conceal, protect or otherwise cover a joint forming a single stair. Typically, the molding 11 is provided atop the first floor element 24 on the horizontal, or run 220 of the stair, such that the stair nose attachment 210 bridges the joint between the first floor element 24 and the second floor element 25, forming the vertical section of the stair, or rise 230. As a result, the invention can be used to cover and protect joints between flooring elements on stairs. While in a preferred embodiment, the floor elements covering the rise 220 and run 230 are the same type of flooring material, the flooring elements need not be of the same construction or type of materials.

The stair nose attachment 210 may include a tab receiving groove 212, permitting connection of the stair nose attachment 210 to the molding 11. Because the tab receiving groove 212 in the stair nose attachment 210 is preferably shaped according to the shape of the tab 18 of the molding 11, the stair nose attachment 210 may be attached to the molding 11 by, for example, snapping or sliding.

Figure 17:
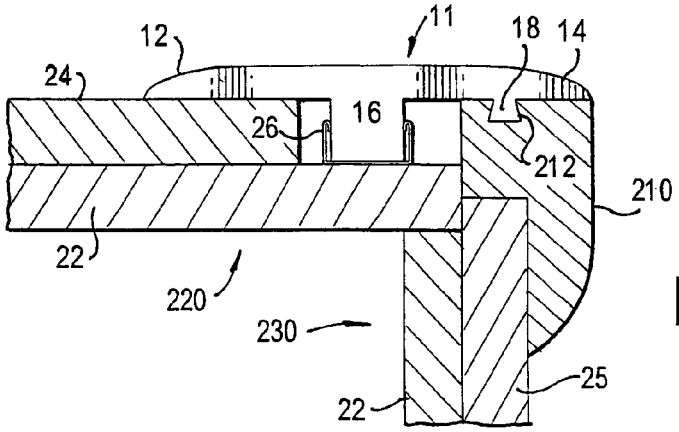
FIG. 17 depicts an embodiment of the assembly of the invention for use with stairs.

However, in other embodiments, the tab on the under surface 36 is eliminated. While the tabs and corresponding grooves may be eliminated, it is nevertheless considered within the scope of the invention to utilize an adhesive, as described herein. Alternatively, the stair nose attachment 210 may include a tab 218 to mate with a corresponding groove 219 on the foot 16 of the molding 11 (FIG. 17), or vice-versa.

By allowing an end user to purchase the generic element 300 instead of separate components, the retailers and/or distributors may accordingly reduce their inventory requirements. For example, typically over one-hundred different design patterns for the outwardly facing surface 34 of the molding 11 (as well as for the leveling block 40 and stair nose attachment 210) are produced. By allowing for the inventory to include only the generic elements of the invention, the total number of components retained can be reduced from three per design to one per design. Similarly, the installer only need purchase the generic elements 300, rather than three individual components. Thus, both retailers and installers may profit from having less storage and/or retail bays to service the same types of accessories as prior to the invention.

FIGS. 20-53 depict alternate embodiments for the leveling block (or other pieces) and the molding 11.

FIG. 20 shows a general representation of the molding with a track 101 and shim 102, below the molding 11. Preferably, the track 101 is metal, and the shim 102 is plastic. However, it is within the scope of the invention to form either of these pieces out of either material. Additionally, other materials may be used, such as materials which flex, but return to their original configuration when pressure is applied and then released. In one embodiment, a track 101, formed of metal, is fastened to a subfloor with screws. For thicker laminate flooring, the shim 102 may be snapped to the underside of the track before it is fastened to the subfloor. Use of the shim 102 offers a height adjustment for multiple thicknesses of laminate, or other flooring. Thus, where the height of a surface below the molding 11 requires the molding to be raised, the shim 102 can be used to provide the necessary spacing. However, it must be noted that, although FIG. 20 shows the shim 102 being used, such is an optional element, as the shim 102 may be used with each of the shapes and designs of moldings 11 disclosed herein, or similarly, eliminated from each embodiment, as required by the particular circumstances.

As shown in FIGS. 90-99 and 102-111, the shim 102 may be in the form of a pad 1102, which may be provided with one or more upturned ends 1102*a* and 1102*b*. Preferably, the upturned ends 1102*a* and 1102*b* of the pad 1102 are sized and shaped to receive foot 1116 if desired. Thus, in a number of embodiments, shown for example in FIGS. 102-111, the foot 1116 is positioned in the pad 1102, such that the upturned ends 1102*a* and 1102*b* grip or grasp the clamp 1126. If the upturned ends 1102*a* and 1102*b*, or even the entire pad, 1102 are formed from a resilient material, such as a plastic or elastomer or certain types of metal, the gripping force provided can be greater. However, the pad 1102 and the parts thereof can be constructed of any material. The pad 1102 may additionally be affixed to a clamp 1126 with a fastener, such as a screw or nail, and/or an adhesive, such as a glue or adhesive tape. In the embodiment shown in FIGS. 98, 99, 110 and 111, the pad 1102 is inverted, such that upturned ends 1102*a* and 1102*b* are directed toward the subfloor and away from the clamp 1126 in order to provide the clamp 1126 with additional height. This allows a single pad 1102 to accommodate a variety of height requirements. Moreover, if needed, it is possible to cut off a terminal section of the upturned ends 1102*a* and 1102*b* to accommodate an unlimited number of additional heights. The size and depth of the pad 1102 is not limited by the present invention and is typically any height, from 1 mm up to 4 mm, with additional height being provided when the pad 1102 is inverted. Typically, the pad 1120, just like the shim 102, is sized in accordance with the clamp 26, 1126.

The size of the clamp 1126 is not particularly limited by the present invention. Typical clamp 1126 heights can be any dimension, preferably from 6-10 mm, most preferably 6.55 or 6.8 mm.

Figure 21A:
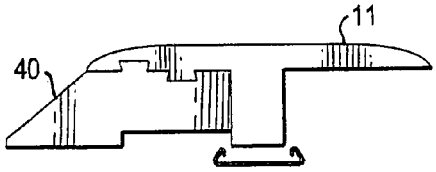
Figure 21B:
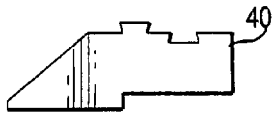
Figure 21C:
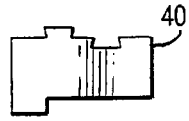

The embodiment of FIG. 21 has a leg of the molding 11 extended. Herein, there is a choice of height adjusting shims, which, in addition to the snap-on shim 102, may additionally include a second shim 103, formed of any material, such as wood, plastic, fiberboard, stone, metal, etc., that can be attached via any method to either the molding or the subsurface, such as with an adhesive, or screw. Typically, the extended leg of the T-molding is fastened to a subfloor with a silicone sealant, acting as an adhesive. Such a construction permits easy and quick installation, especially avoiding the need to drill holes and insert plugs for screws when installing over a concrete subfloor. The shim 102 can be attached to the underside of the extended leg of the T-molding to provide the appropriate height adjustment.

FIGS. 20 and 21 additionally represent the double and reversed tongue-and-groove configuration that functions to fasten a foot, hard surface reducer or carpet/end molding to the T-molding. In this configuration the tongue that extends from the underside of the T-molding is placed so that it falls within the expansion space of the installed flooring transition. This configuration does not require the removal of this tongue in order to install the T-molding part as a T-molding only. Should the laminate floor expand, the pressure will be sufficient to shear off this tongue on the underside of the molding, and the floor can move freely as if there were no extended tongue present in the expansion space.

Preferably, the shim 102 is a metal or plastic structure, having a pair of grabbing flanges 102*a* for the purpose of clamping onto, for example, the track 101. The grabbing flanges 102*a* typically form an acute angle with respect to the remainder of the shim 102, such that when the molding 11 is inserted into the shim 102, the grabbing flanges 102*a* are forced outward, and the grabbing flanges 102*a* function to hold the molding 11 in place.

Figure 25A:
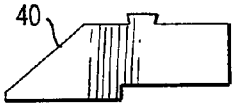
Figure 25B:
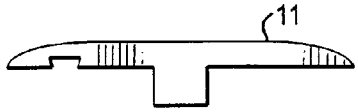
Figure 25C:
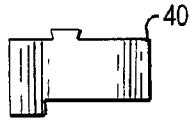

In a preferred embodiment, the molding 11 and a second member, such as a reducer, leveling block, stair nose, or any other molding attachment, are joined by one or more tongue-and-groove joints. For example, the second member can be provided with a tongue and the molding 11 is provided with a matching groove. As shown in FIGS. 25 and 26, the tongue, which may be located on the second member, may be shaped as a dove-tail or a "half dove-tail," wherein only one of the two sides defines an angle other than ninety degrees. Such a tongue may extend over any potion of the mating surface, such as small amount (FIG. 25), approximately half (FIG. 26), or even substantially the entire mating surface.

Typically, the tongue-and-groove are not simply rectangular in shape, but are provided with elements which tend to hold the pieces together. For example, as shown in FIGS. 20, 21, 25, 28, and 29, the tongue may have, on at least one side, a tapered surface, resembling a dovetail, such that the pieces cannot simply dissociate without manipulation.

In the embodiments of FIGS. 20 and 21, the reducer has on its mating surface, one tongue and one groove, while the molding 11 has the matching groove and tongue. In FIG. 21*a*, the extended leg of the T-molding allows the T to be adhered to the sub-floor with construction adhesive or tapes or other adhesives. A shim can be placed on the bottom of the extended leg of the T-molding to raise the height, either a snap-on type of shim or a simple rectangular piece of material which can be adhered onto the bottom of the foot and then the assembly is adhered to the floor.

FIGS. 22 through 27 can represent either installation method, with a track or with an extended leg on the T-molding for, T-molding, hard surface reducer, carpet/end molding and stair nosing.

Figure 22A:
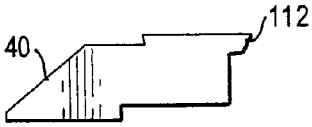
Figure 22B:
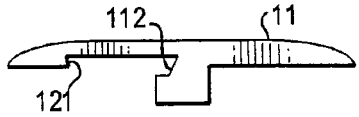
Figure 22C:
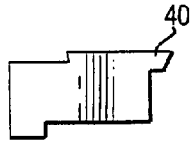
Figure 23A:
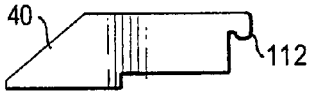
Figure 23B:
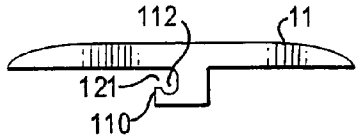
Figure 23C:
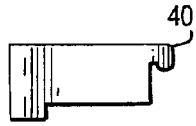

In the embodiments of FIGS. 22 and 23, the pieces are provided with a horizontal flange 111 and the molding 11 has a similarly shaped groove. In FIG. 22, the groove is not provided with any locking elements, while in FIG. 23, the groove is provided with a locking flange 121, which joins with a locking groove 112 on the second member to hold the pieces together. Although not specifically shown, it is within the scope of the invention to swap the location of the tongue/groove, such that the tongue is on the molding 11, and the groove is positioned on the second member. Similarly, there may be any number of matching tongues/grooves, and each piece may have any combination of tongues and grooves. Similarly, as shown in FIG. 27, the tongue and groove need not be positioned adjacent to the underside of one of the arms of the molding 11, and a gap 114 may be provided in the second member to allow for greater movement between the second member and the first member without permitting dissociation. This gap may be a break-away feature.

In FIG. 22, a recess lateral slot is present on the underside of the T-molding, as well as a groove in the leg of the T-molding. The recessed slot and raised platform of the top of each foot hinders lateral movement of the foot and the tongue and groove stabilize the foot against the top of the T-molding.

In FIG. 23, there is a tongue and groove with a snap-fit ridge or tab at the end of the groove or in the tongue of the leg of the T-molding. There is also shown a corresponding groove in the underside of the tongue of each foot that snaps into the tab.

Figure 24A:
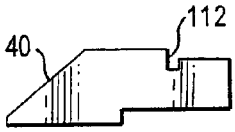
Figure 24B:
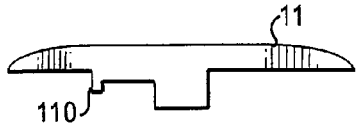
Figure 24C:
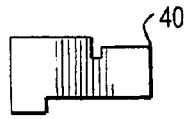

In the embodiment of FIG. 24, the locking element 110 is a downwardly facing flange, sized and shaped to mate with the locking groove 112 on the second member. When the pieces are connected, the locking element 110 and locking groove 112 function to resist separation of the pieces in a horizontal direction. Although not shown, the locking element 110 and locking groove 112, as shown in FIG. 24, may be combined with any of the structures as shown in any of the other embodiments disclosed herein in order to assist in maintaining a secure connection between the elements.

In one embodiment, the extension 114 is affixed to the subfloor, by a means for securing. The securing means may be, for example, a mechanical fastener or a chemical fastener through, for example, boss 134. As used herein, a mechanical fastener is any device which joins the elements with, e.g., pressure, and includes, but is not limited to, a nail, screw, staple, claw, clamp, barb, cant hook, clapper, crook, fang, grapnel, grappler, hook, manus, nipper, paw, pincer, retractile, spur, talon, tentacle, unguis, ungula, brad, point, push pin, and tack. Additionally, a chemical fastener is a component, such as a sealant or adhesive, and includes tapes, glues and epoxies. This extension 114 may also attach to the track.

Figure 34:
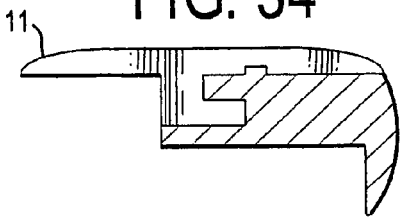
Figure 35:
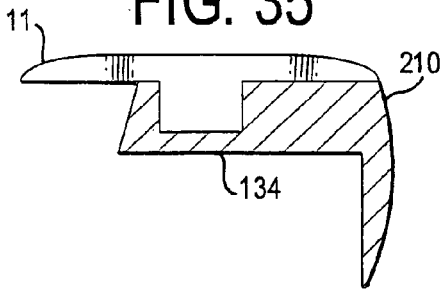
Figure 36:
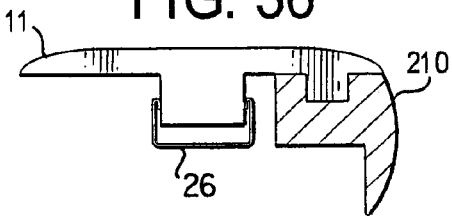
Figure 37:
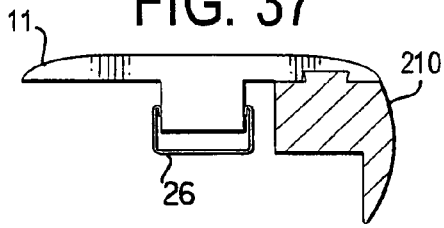
Figure 38:
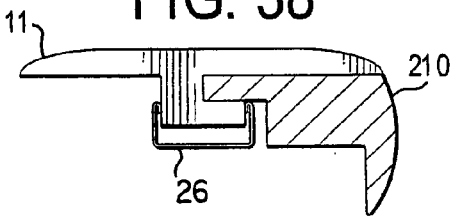
Figure 39:
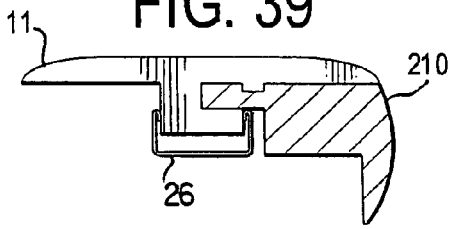
Figure 40:
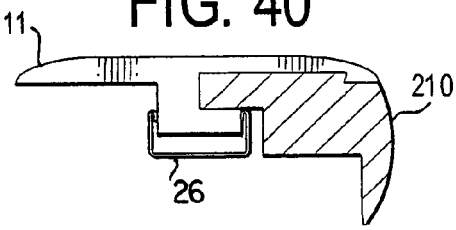
Figure 41:
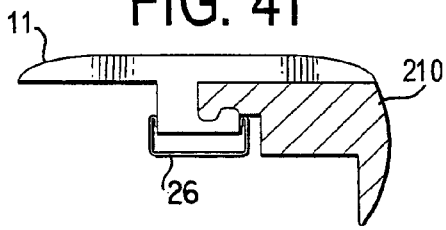
Figure 42:
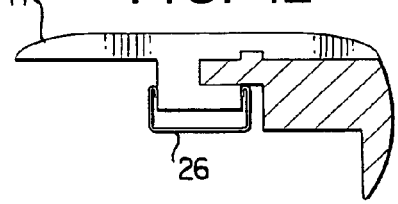

The embodiments shown in FIGS. 28-35 each have an extension 120 of the second member which extends below the foot of the molding. In such embodiments, typically, the second member is a stair molding and is secured to the subfloor. The T-molding is then attached to the second member, as the T-molding does not contact the subfloor. However, it is considered within the scope of the invention to additionally provide an extension bracket (not shown) for securing the T-molding to the subfloor. As shown in FIGS. 28, 29 and 35, the second member may include a recess 124 into which the foot of the T-molding is inserted, or in the alternative, a depression 126 (FIGS. 30, 33 and 34).

Additionally, the second member may have a wedge 128 (FIGS. 31 and 32) to secure the T-molding in place. The foot of the T-molding may either be angled into position to bypass the uppermost section of the wedge 128, or the wedge may be formed such that it deflects under pressure and snaps back after the foot of the T-molding is properly positioned. Again, the embodiments of FIGS. 28-35 may be combined with one or more of the tongue and groove configurations as shown or described in connection with FIGS. 20-27.

The second member, shown as a stair nosing, in FIGS. 28-35 may be installed using construction adhesives, specialized tapes (such as simple double-sided tapes), silicone or other sealants (such as epoxies or glues) or mechanical fasteners (such as screws or nails).

The embodiments of FIGS. 36-42 can be installed using a track 101, similar to the embodiments shown in FIGS. 20-27. In particular, either one or both of the T-molding and second member (shown as a stair nose) may be secured with the track 101. The members can also be fastened to the track 101 after a construction adhesive or sealant/adhesive has been applied into the track and/or additional mechanical fasteners may be used to assist in fixing the second member to the subfloor (or tread, as necessary).

Figure 43:
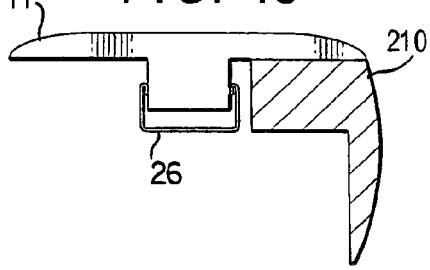

FIG. 43 demonstrates an extended face for a stair nose. Therein, the extended face is sufficient in breadth to cover the edge of common stair treads, thus eliminating the need to place a separate piece of flooring on the edge of stair treads or to cover the edge of a subfloor when stepping down from a floating floor installation to a lower level floor. However, stair noses may also be installed using the method described in connection with FIG. 21, above, without the need of a track 101, when the T-molding has an extended leg.

The embodiments of FIGS. 44-53 allow installation of the multipurpose flooring transition using only adhesives, tapes or sealants, as no track 101 is required. The additional surface area beneath the transition is increased adding additional adhesion area for strength in bonding the transition to the subfloor. This installation method also avoids the need for a track, screws and/or plugs (although they are certainly not prohibited), and additionally allows for faster installation over subfloors formed from, for example, wood based products or concrete.

FIGS. 44 and 45 show two assembled members held together with glue before fastening to the subfloor. Such members may also be installed by other methods described herein.

FIGS. 46-49 depict two members joined together with a snap-fit, such that no glue is necessary. Such members may also be installed by another method described herein. Although FIGS. 46-49 show a particular location for various snap-fitting elements, i.e., tongue and groove, it is certainly within the scope of this invention to increase the size, shape, location and number of the tongues and grooves as necessary. For example, FIG. 30 depicts one groove on either side of the foot of the T-molding and corresponding tongues on the second member. However, additional tongues/grooves may be located on the bottom of the foot or even on the underside of the arm. Additionally, the second member may include both tongues and grooves, combining the features illustrated in FIGS. 46 and 47 with FIGS. 48 and 49.

FIG. 50 represents a shim, which can be made from waste cuttings of the core material during the manufacture of the transition. This shim may be used to elevate the foot of the assembly to accommodate a thicker flooring material.

FIG. 51 shows an additional embodiment wherein the second member is a stair molding. The pieces, i.e., the T-molding and the stair molding, can be held together with glue before fastening to the subfloor, or by any other installation method described herein.

In FIG. 52, an additional T-molding is shown that can snap-fit, i.e., without the need for glue, and FIG. 53 shows a corresponding track or structure to be incorporated into a second member. Specifically, the second member piece of FIG. 53 includes a plurality of alternating tongues and grooves, such that the foot of the T-molding, also having alternating tongues and grooves, form a snap action that functions to hold the T-molding firmly. Additionally, this design permits the elimination of the shim 102, as the foot of the T-molding need not be completely seated in the second member. In other words, because the T-molding can be secured to the second member with a gap or space remaining between the bottom of the foot 130 and the inner-most part of the second member 130, height variations can be accounted for without the need for an additional part.

FIGS. 54-66 show an alternate embodiment of the invention. Specifically, as shown in FIG. 64, a single reversible molding element 1001 has an outer face 1005, which extends over a front face 1007 and a rear face 1009. This outer surface 1005 is the same on both the front face 1007 and the rear face 1009, and preferably includes a laminate, but may also be of a foil. While the outer surface 1005 may be limited to only the front face 1007 and the rear face 1009, the outer surface 1005 may extend across any additional surfaces as well. Due to the novel construction of the reversible molding element 1001, the versatility of the invention can be greatly increased.

An example of the versatility of the reversible molding element 1001 is specifically shown in FIGS. 55 and 56, wherein the significant distinction between FIGS. 55 and 56 is the orientation of the reversible molding element 1001. In FIG. 55, the reversible molding element 1001 has its front face 1007 facing outward, while in FIG. 56, the opposite, or rear face 1009 facing outward. As a result, when the front face 1007 is oriented outward, reversible molding element 1001 functions as a hard surface reducer. In contrast, when reversible molding element 1001 is reversed, and the rear face 1009 is oriented outward, the reversible molding element 1001 functions as an end molding. Thus, when the T-molding is put together in a single package with the reversible molding element 1001, the combination can be used as either a hard surface reducer or an end molding, in contrast to other systems which require three independent pieces to accomplish the same result.

When using two parts instead of three, maximum use of materials is accomplished, making the invention more economical to produce and, as a result, more environmentally friendly sound. This new configuration of two pieces allows a third piece to be introduced, also reversible, that broadens the use of the pieces to include a increased range of flooring thicknesses found in such products as hardwood and other finished flooring that could not be previously accommodated. An additional option that increases the range of use of the invention is to permit it to transition to a broader range of flooring thicknesses by adding a second reversible part that is higher (thicker) than the first reversible part.

In FIG. 54, there is a tongue/groove connection in the attachable parts, for example, on the underside of the T-molding. However, it is within the scope of the invention to reverse the position of each of the tongue and groove from that illustrated. This figure shows the reversible molding element 1001 in a configuration with the track and shim, as optionally used in the other embodiments discussed herein.

In FIG. 57 the underside of the T-molding does not have a tongue or groove. It does, however, have a notch or shoulder, which holds the other molding piece, such as the reversible molding element 1001, from moving laterally toward the track. The reversible molding element 1001, preferably, is smooth, without a groove or tab on the surface which comes into contact with the underside of the T-molding. The underside of the reversible molding element 1001 preferably has a groove to accommodate an extension from the track that stabilizes the lateral movement of the reversible molding element, preventing movement away from the track. In order to hold the element 1001 in place, the track can be provided with a gripping flange 1010, which may be formed as a break-away section on the remainder of the track, such that when the gripping flange 1010 is not to be used, it can be easily removed to have the track in a different configuration.

FIG. 58 shows both a groove and stabilizing notch on the underside of the T-molding, with a tab on the reversible molding element 1001.

FIG. 59 shows an extendable track extension 1012, which may be one piece or with break-away elements, and may also act as a shim to raise the track. When used as one piece, the raised tab, on the extension that affixes to the underside of the reversible molding element 1001, can slide beneath the finished flooring when the track is used to hold a T-molding or the height of the tab can be the equivalent to the height of underlayments used in the floating floor application, and will not interfere with the floating floor, because the extension is no higher than the foam underlayment commonly used in such installations, the apparatus does not interfere with the floating floor. When used with the break-away feature, the extension can be removed and the remaining part can be used as a shim to raise the track to accommodate a thicker floor. The track may be joinable with a tongue/groove connection system to prevent relative movement. FIGS. 60 and 62 show a similar attachable extension using thinner material and a different attachment configuration.

In FIG. 61, the underside of the T-molding does not have either a tongue or groove. It does, however, have a notch or shoulder that holds the reversible molding element from moving laterally toward the track. The reversible molding element may also be smooth, i.e., no tongue or groove, on the surface that comes into contact with the underside of the T-molding. These parts can be assembled with any type of glue or adhesive, such as fresh glue, pre-applied glue, encapsulated glue, reactive adhesives, contact adhesives or adhesive tapes.

Figure 63:
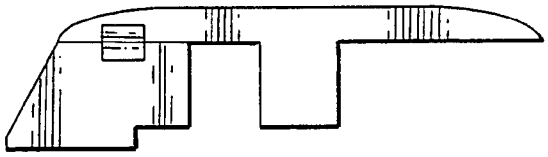
Figure 64:
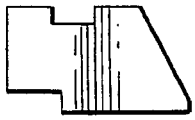

In FIG. 63, the T-molding has a milled groove 1012. The top of, for example, the reversible molding element also has a groove 1014. To complete assembly, a loose double-sided tongue 1016 can be pressed into the groove 1012 as the reversible molding element 1001 is attached to the tongue 1016. The tongue 1016 can be pressure fit or glued into one or both of the grooves 1012, 1014.

Figure 65:
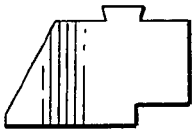
Figure 66:
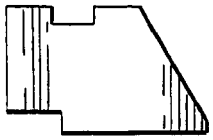

The two different sizes of elements 1001 of FIGS. 65 and 66 allow for accommodation of a wide range of thicknesses.

Figure 67A:
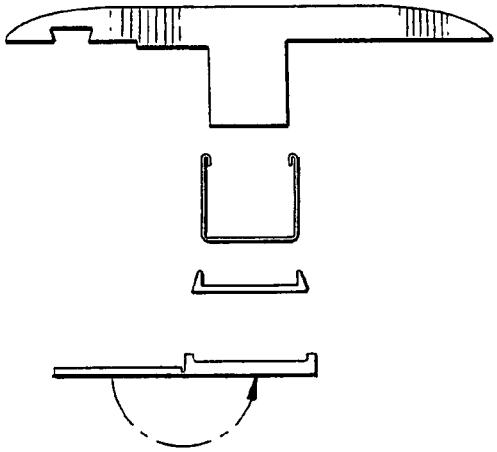
Figure 67B:
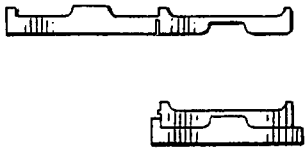
Figure 68:
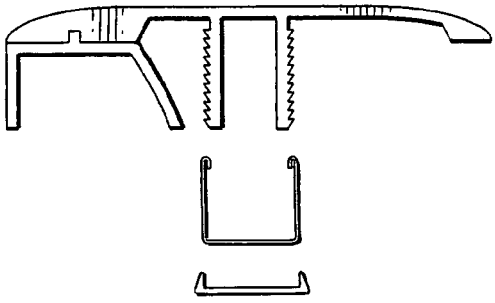

In FIG. 67*a*, there is a groove and stabilizing notch on the underside of the T-molding, and a tab on the reversible molding element 1001 (not shown). Here, the T-molding can accommodate either reversible parts (such as those shown in FIGS. 65 and 66), and a shim can be used with an extension (which can be broken away or folded under the shim) to increase its thickness to raise the track and accommodate thicker flooring. FIG. 67*b* shows the break-away shim extension with tabs that can snap to the underside of the shim.

FIGS. 68-80 utilize the reversible concept with aluminum or other metals or composites. Generally all of the same features of the previously described materials can be used with these elements. These structures may additionally be covered, at least in part, by a décor layer (which may be, optionally directly, digitally printed and coated or a décor sheet which can be subsequently coated), such as a foil or other laminate structure.

Figure 69:
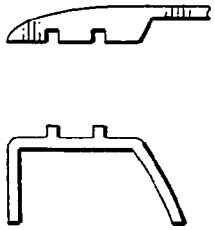

FIG. 69 shows two grooves in the T-molding and two matching tongues on the second or reversible molding element. Again, the location of the tongue/groove of any embodiment described herein can be swapped without departing from the invention.

Figure 1A:
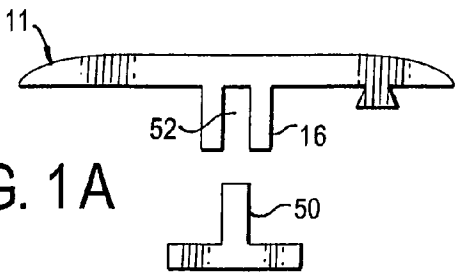
Figure 70:
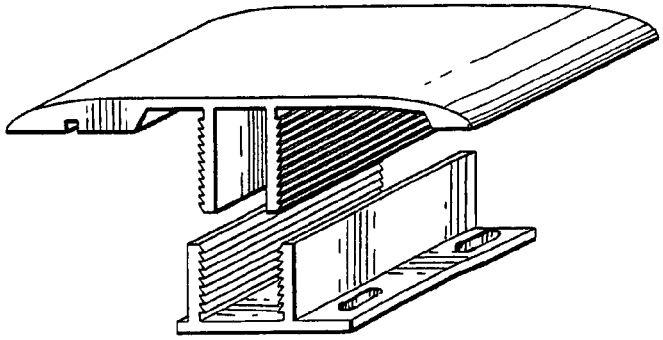

FIG. 70 shows a T-molding with one single foot and a track to accommodate this foot, similar to FIGS. 1A and 1B.

Figure 71:
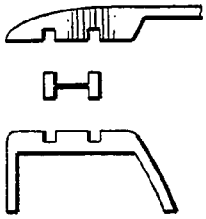

FIG. 71 shows a T-molding and a reversible molding element with grooves that can accommodate a clip 1020 that joins the two parts together. The clip has a similar function as the double-tongue of FIG. 63.

Figure 72:
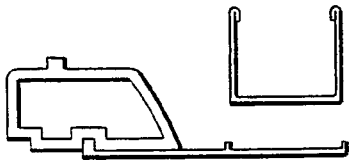

FIG. 72 shows a reversible molding element with a tab on the top and groove on the underside to accommodate a track extension and aid the prevention of lateral movement, similar to that which is shown in FIG. 57.

Figure 73:
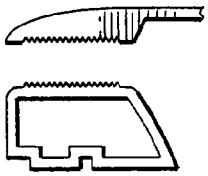
Figure 75:
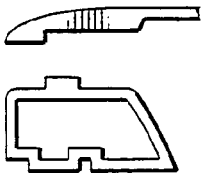
Figure 76:
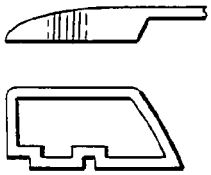

In FIG. 73, the T-molding is provided with serrated grooves 1022 which match similar grooves 1024 on the reversible molding element. These grooves may be serrated "inwards" to hinder pulling-out of the reversible molding element, or inwards, to hinder the reversible molding element from being pushed inward, i.e., toward the foot of the T-molding. Alternate embodiments which differ from the traditional tongue/groove connection are shown in FIGS. 75 and 76. The T-molding can have a notch or shoulder and the reversible molding element can have a corresponding tongue to prevent lateral movement away from the track. The pieces may also be smooth and held together with an adhesive, as described elsewhere herein, or may be held together using only the track extension.

Figure 74:
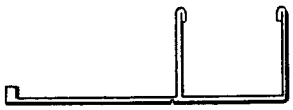

In FIG. 74, the track is shown with an extension as a break-away section, similar to that which is shown in FIGS. 60 and 62.

FIGS. 77-80 show a metal or composite stair nose attachment in accordance with the invention.

Figure 77:
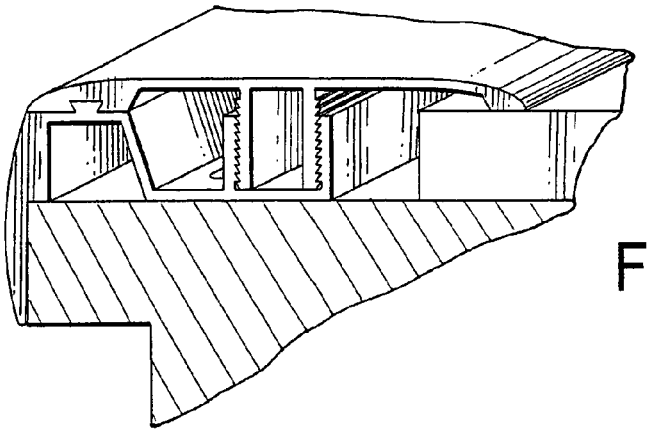

In FIG. 77, the stair nose is attached to a T-molding, which need not be formed from an aluminum. This structure may be from HDF, MDF, plastic, or other metal or composite materials. Such composites can include combinations of wood based and plastic resin composites. Hidden fasteners, which are not visible from the surface of either element can be used to secure the elements to the subfloor. There can also be a track to hold the elements in place.

Figure 78:
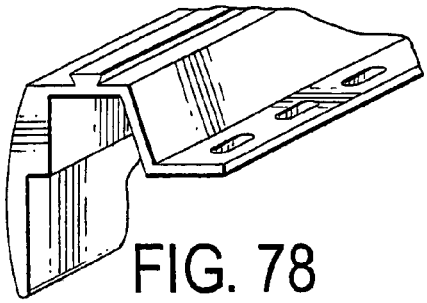

In FIG. 78, the stair nose is a separate piece apart from the T and the track. It can be fastened to the subfloor or stair tread with screws through apertures 1030 integrated into the structure of the stair nose. The separate track can be secured to the subfloor also with separate screws. Additionally, the same screws may be used to affix the track and the stair nose. The T-molding can be attached to the stair nose by the tongue and groove and can be held to the subfloor or stair tread by the track.

Figure 79:
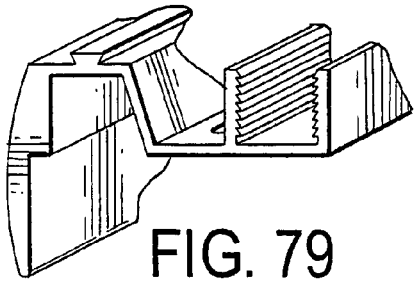
Figure 80:
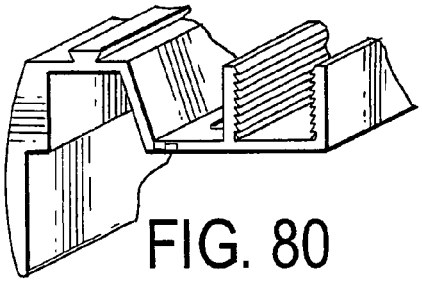

FIGS. 79 and 80 show the stair nose and track as one piece. While the track and stair nose can be separately formed, and joined, for example, by a tongue/groove system, they can also be formed and sold as a single unit.

Figure 81:
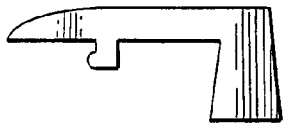
Figure 82:
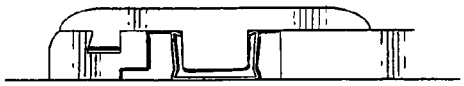
FIGS. 82-111 depict additional modifications of the molding the invention.
Figure 83:
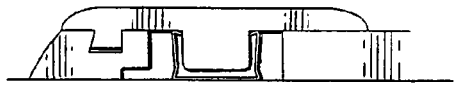
Figure 84:
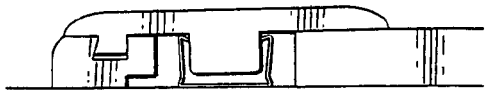
Figure 85:
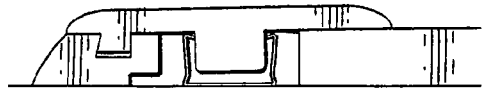
Figure 86:
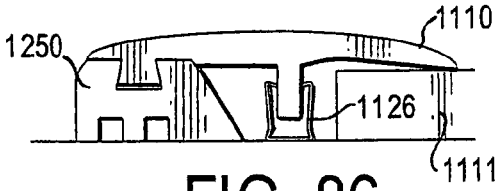
Figure 87:
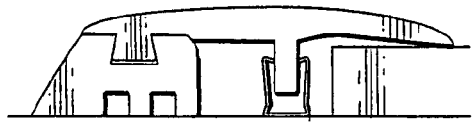
Figure 88:
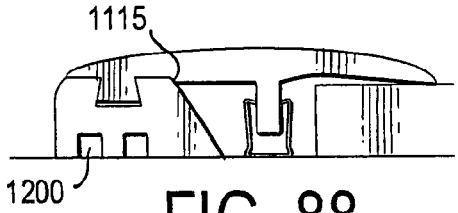
Figure 89:
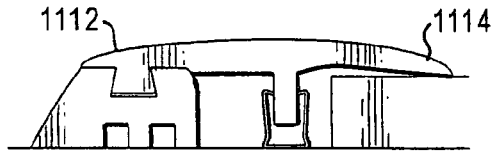
Figure 90:
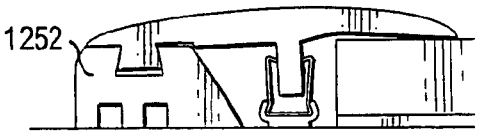
Figure 91:
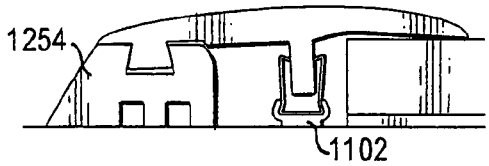
Figure 92:
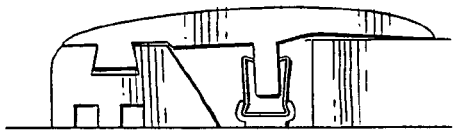
Figure 93:
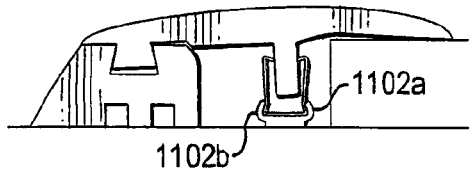

FIG. 81 shows a modification of the T-molding of the invention. Specifically, it is possible to remove one of the arms or members from the T-molding to create an end molding or carpet reducer. This T-molding 1801 can be in accordance with any of the embodiments described herein. For example, the T-molding 18801 may be formed from HDF, MDF, metal or composite, and optionally provided with a décor layer, which may be printed or otherwise provided directly on the surface. Additionally, the removable section may be pre-fabricated as a frangible section, as is shown and described in accordance with FIG. 19. A kit, such as a single package, may also be provided which includes at least two, but preferably all, of the individual parts described herein.

As shown in FIG. 19, it is also possible to form the molding 11, leveling block 40 and stair nose attachment 210 from the same element. Specifically, a generic element, indicated at 300 can be milled, sawed or otherwise constructed with a variety of "break away," or readily separable, sections 300A, 300B, and 300C. When one or more sections 300A, 300B, 300C are removed, by for example, scoring and snapping, cutting, sawing or simply bending, the individual pieces can result. Preferably, the generic element 300 is initially formed as a unitary structure which is then scored as to provide stress-points to allow the removal of the sections. While not required by the present invention, typically, the removal of the break away sections 300A, 300B, 300C requires a significant amount of physical force or labor, as the remaining structure must maintain its structural integrity. Alternatively, removal of the sections 300A, 300B, 300C may require the use of a specialized tool.

By designing the generic element 300 in accordance with the invention. An installer can manipulate the generic element 300 to produce any needed component. For example, removing sections 300B and 300C would produce a typical stair nose attachment 210, while removing sections 300A and 300C would produce a typical molding 11. Due to this construction, it is possible to manufacture the generic elements to be purchased with appropriate selection being left to the installer. Similarly, when removing sections 300A and 300C to form the molding 11, section 300A can be used as a leveling block as described herein.

By allowing an end user to purchase the various pieces as an assembled generic element 300 instead of separate components, the retailers and/or distributors may accordingly reduce their inventory requirements. For example, typically over one-hundred different design patterns for the outwardly facing surface 34 of the molding 11 (as well as for the leveling block 40 and stair nose attachment 210) are produced. By allowing for the inventory to include only the generic elements of the invention, the total number of components retained can be reduced from three per design to one per design. Similarly, the installer only need purchase the generic elements 300, rather than three individual components. This results in savings both to the retailer and installer by reducing the space needed for retailing bays and storage, respectively.

The molding 1110 may also be provided with a shoulder 1115, located preferably on the underside of one of the arms 1114, 1112. This shoulder can be similar to the stabilizing notch shown in FIGS. 56-61. The position of the shoulder is typically selected to provide a stop surface to the attachment 1140 to help prevent lateral movement of the attachment 1140 with respect to the molding 1110. This shoulder 1115 is preferably formed by a beveled cut into the surface, such that when the attachment 40 is seated in shoulder 1115, movement of the attachment 40 is hindered. The presence of this shoulder 1115 can eliminate any gap or space at the distal or exposed edge of the molding element 1140, 1250 as it meets the surface of the subfloor or floor element.

The attachment 1140 can also be provided with one or more spacing gaps 1200 on an undersurface thereof (FIGS. 86-99, 100, 102, 104, 106, 108 and 110). When used with an appropriately sized spacer 1210, the molding 1110 and attachment 1140 can be used with a wide variety of flooring thicknesses, from as small as 6 mm or smaller to as large as 15 mm or larger. The spacers 1210 are typically formed from a rigid or flexible plastic material, preferably, a solid thermosetting plastic. However, it is within the scope of the invention to construct the spacers 1210 of a thermoplastic, such as polyvinyl chloride (PVC) or a resilient foam material. Additionally, the spacer 1210 preferably includes at least one extension 1212, sized and shaped to fit within a spacing gap 1200.

In one embodiment, at least the extension 1212 is formed from a resilient compressible material, such as a structural foam, and is slightly larger in width than the width of the spacing gap 1200. When the extension 1212 is inserted into the spacing gap 1200, it is necessary to compress the extension 1212. Because the extension 1212 in this embodiment must be compressed to be inserted into the spacing gap 1200, the internal forces of the material of the extension 1212 should maintain the spacer 1210 in the correct position.

As a substitute for the compressible embodiment or in addition thereto, the spacer 1210 may be joined to the spacing gap 1200 with an adhesive. Typical adhesives include any of the other adhesives discussed elsewhere. However, it is within the scope of the invention to eliminate any means for securing the spacer 1210 in the spacing gap 1200.

Figure 94:
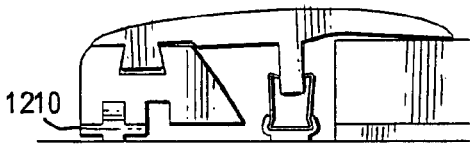
Figure 95:
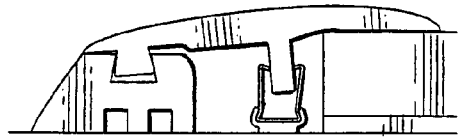
Figure 96:
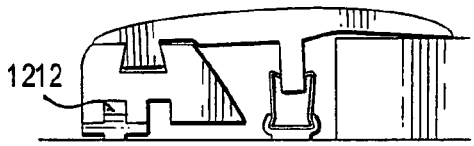
Figure 97:
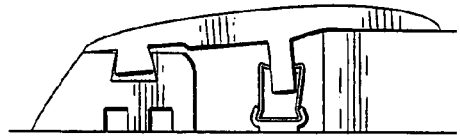
Figure 98:
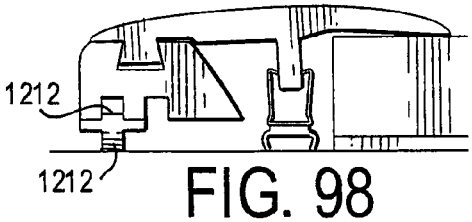
Figure 99:
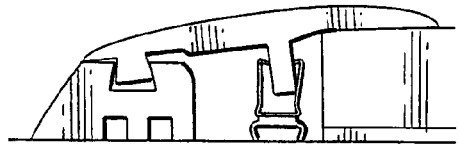
Figure 100:
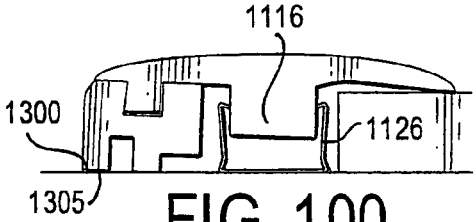
Figure 101:
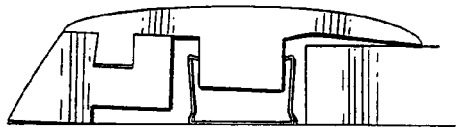
Figure 102:
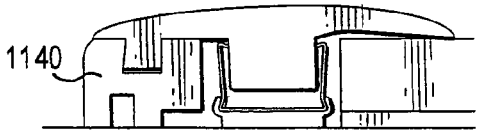
Figure 103:
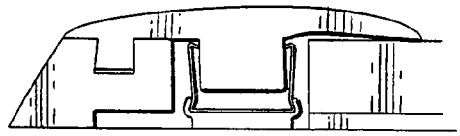
Figure 104:
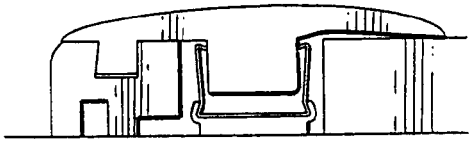
Figure 105:
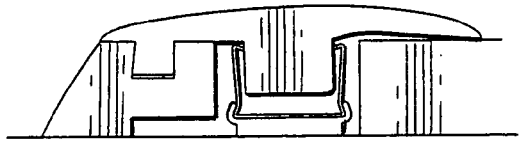
Figure 106:
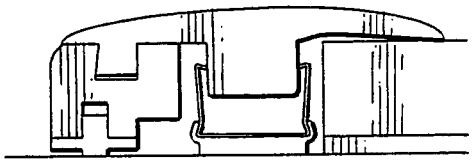
Figure 107:
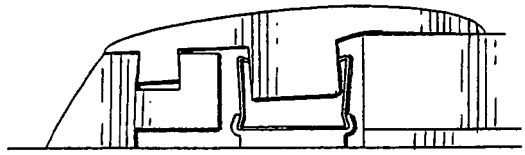
Figure 108:
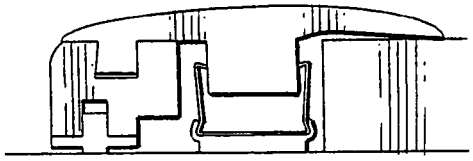
Figure 109:
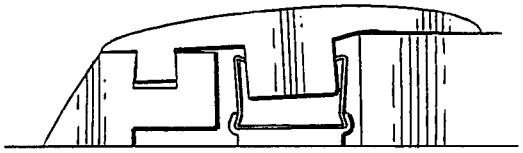
Figure 110:
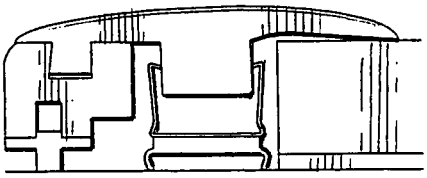
Figure 111:
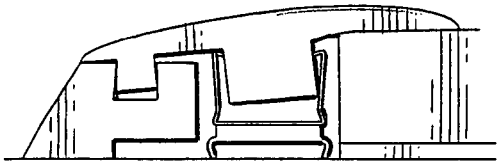
Figure 112:
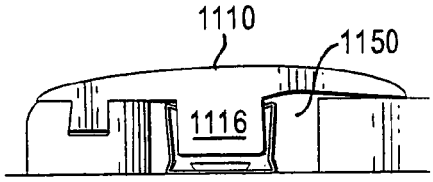
FIGS. 112-119 show even further modifications of the molding of the invention.
Figure 113:
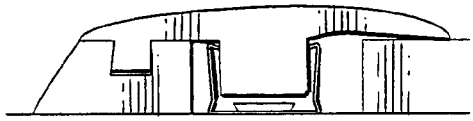

In a preferred embodiment, a different reversible molding element 1250 can be used, having an end molding surface 1252 and a hard surface reducer surface 1254 and two spacing gaps 1212*a*, 1212*b* in the lower surface thereof. The presence of one spacing gap associated with each of the molding surfaces allows one spacer 1210 to be used closest to the exposed surface of the reversible molding element 1250, as shown in FIGS. 94, 96 and 98. Although these figures show the reversible molding elements 1250 having two spacing gaps 1200 positioned in an underside thereof, it is within the scope of the invention to utilize a single spacing gap 1200 positioned, for example, centrally or not centrally, i.e., off center, in the underside of the reversible molding element 1250.

Typically, the height of the reversible molding element 1250 or 1140 permits the molding 1110 to rest parallel to the higher surface element 1111 when used with an appropriately sized spacer 1210. In order to provide such appropriately sized spacers 1210 for a variety of different applications, the spacer 1210 may include a second extension 1212. As shown, for example in FIG. 98, the extensions 1212 are preferably located on opposite sides of the spacer 1210, such that inverting the spacer 1210 allows insertion of the correct extension 1212 into the spacing gap 1200. It is also considered within the scope of the invention to provide the spacer 1210 with up four or more extensions 1212 of different lengths to permit use in a large number of different installations.

It should be understood that the spacer 1210 is not necessary. The shape of the molding element 1140 and/or reversible molding. 1250 allows an installation wherein the molding element 1140, 1250 rests directly on the subfloor. In certain installations, depending in part on the height of the adjacent flooring elements, this can cause the molding 1110 to form an angle with the flooring elements. However, such an angle is not problematic, as clamps 1126 used in accordance with the invention are preferably versatile enough to sufficiently grip the foot 1116 of the molding 1110 despite the presence of such an angle.

By utilizing the embodiments shown in FIGS. 100-111, it is possible to eliminate a gap 1300 between the subfloor and the molding by providing the molding 1140, 1250 with an angled cut 1305. The moldings 1140, 1250 depicted in these figures are similar to that which are shown in FIGS. 112-119 with the same undercut. However, the foot 1116 that fits into the clamp 1126 is longer than the foot 1116 of FIGS. 112-119.

The embodiment of FIGS. 112-119 differs from prior designs in a variety of ways. The molding 1110 can be made thicker to provide additional strength, as well as to allow for easier placement of an undercut 1150. This undercut 1150 is preferably located on the portion of the molding 1110 that rests on a surface of the finished flooring. In some embodiments, the undercut 1150 provides close contact, i.e., no gap, between the surface of the floor and the outer edge of the molding 1110 as the flooring increases in thickness and raises the molding 1110 from a horizontal position to a more angular position, as described above.

Figure 114:
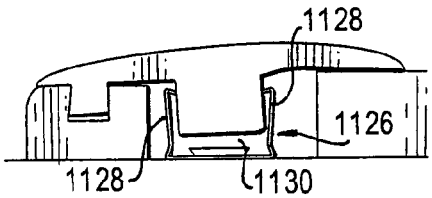
Figure 115:
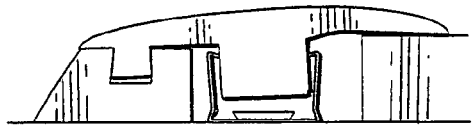
Figure 116:
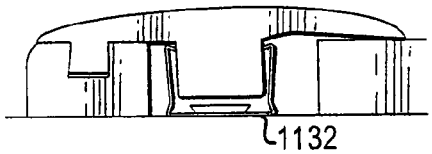
Figure 117:
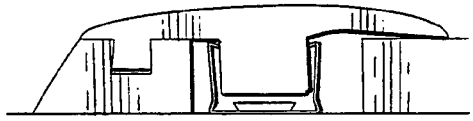
Figure 118:
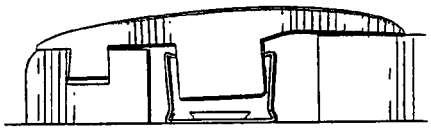
Figure 119:
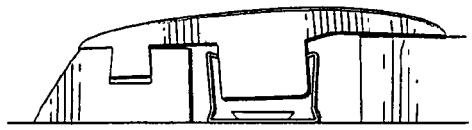

Additionally, the clamp 1126 and pad 1120 configuration may be replaced by a reconfigured track 1126' as shown, for example, in FIG. 114. In this embodiment, the clamp 1126 and pad 1120 are combined into a single structure, which structure is secured to the subfloor and grips the foot 1116 of the molding 1110. Preferably, the track 1126' has a general H-shape, with two upstanding sections 1128 and a middle horizontal section 1130. As the pad 1120 may also be used in an inverted orientation to achieve multiple configurations, the track 1126' may also be inverted for the same purpose. Accordingly, in a preferred embodiment, the middle horizontal section 1130 is not placed exactly at the middle of the heights of the upstanding sections. Thus, when the molding 11, 1110 is inserted into the track 1126', the lowest point of the foot 16, 1116 can be supported by the middle horizontal section 1130. The entire structure of the track 1126' can be formed from a resilient, but structural material, just as the clamp 26, 1126 may be.

The track 1126' may be secured to the subfloor though a variety of methods. In one embodiment, as shown, for example, in FIG. 116, one or both of the upstanding sections 1128 may have a base 1132 which can be secured to the subfloor with a screw or nail or adhesive. A fastener may also be positioned through the middle horizontal section 1130 to secure the lowermost portions of the upstanding sections to the subfloor.

The invention additionally includes packaging to be used by, for example, wholesalers or retailers. In one embodiment, multiple individual pieces, e.g., a reversible molding 1250, a molding 11, 1110, a pad 1120 and a clamp 1126 may be bundled in a single package or kit. In another embodiment, the package or kit includes two, or three, or even up to twenty or more, of each piece packaged therein. For example, a single package may include three approximately one-meter (or three foot) sections of each item contained therein, for a total length of about three meters (about nine feet). It is additionally within the scope of the invention to include different sets of items in a single package, for example, one set being about one meter (about three feet) long and an additional set being about two meters (about six feet) long.

It should be apparent that embodiments other than those specifically described above may come within the spirit and scope of the present invention. Hence, the present invention is not limited by the above description.

I claim:

1. A joint cover assembly for covering a gap between two floor elements covering a subsurface, the assembly comprising:

a first molding element comprising an upper section having an exposed surface, the exposed surface comprising a décor, and a foot depending therefrom; and a second molding element comprising:

an upper surface, joined to the first molding element;

a lower surface having a groove and an exposed lateral surface; said exposed lateral surface having a décor, wherein the décor of the upper section of the first molding element and decor of the exposed lateral surface of the second molding match; and a track, said track comprising a U-shaped portion to receive the foot, and further comprising a gripping flange to be received by the groove, wherein said gripping flange comprises at least one upstanding protrusion to be received by the U-shaped portion of said track.

2. The joint cover assembly of claim 1, when the gripping flange of the track comprises a break-away portion.

3. A joint cover assembly for covering a gap between two floor elements covering a subsurface, the assembly comprising:

a first molding element comprising an upper section having an exposed surface, the exposed surface comprising a décor, and a foot depending therefrom; and a second molding element comprising:

an upper surface, joined to the first molding element;

a lower surface having a groove and an exposed lateral surface; said exposed lateral surface having a décor, wherein the décor of the upper section of the first molding element and decor of the exposed lateral surface of the second molding match; and a track, said track comprising a U-shaped portion to receive the foot, and further comprising a gripping flange to be received by the groove The joint cover assembly according to claim 1 wherein said gripping flange comprises at least one upstanding protrusion to be received by the U-shaped portion of said track, wherein the gripping flange is provided with at least two upstanding protrusions to position the U-shaped portion of the track.

4. The joint cover assembly of claim 3 wherein the gripping flange comprises a third upstanding protrusion to be received by a portion of the U-shaped portion of the track.

* * * * *